US005623240A

United States Patent [19]

Sakuraba et al.

[11] Patent Number: 5,623,240

[45] Date of Patent: Apr. 22, 1997

[54] COMPACT SUPERCONDUCTING MAGNET SYSTEM FREE FROM LIQUID HELIUM

[75] Inventors: Junji Sakuraba; Fumiaki Hata; Chong C. Kung; Yutaka Yamada; Kazunori Jikihara; Tsuginori Hasebe, all of Kanagawa; Kazuo Watanabe, Miyagi, all of Japan

[73] Assignee: Sumitomo Heavy Industries, Ltd., Tokyo, Japan

[21] Appl. No.: 114,173

[22] Filed: Sep. 1, 1993

[30] Foreign Application Priority Data

| | | | |
|---|---|---|---|
| Oct. 20, 1992 | [JP] | Japan | 4-281710 |
| Oct. 20, 1992 | [JP] | Japan | 4-306295 |
| Oct. 20, 1992 | [JP] | Japan | 4-306296 |
| Oct. 22, 1992 | [JP] | Japan | 4-073753 U |
| Oct. 22, 1992 | [JP] | Japan | 4-284460 |
| Oct. 23, 1992 | [JP] | Japan | 4-309639 |
| Jan. 12, 1993 | [JP] | Japan | 4-003071 U |

[51] Int. Cl.[6] ..... H01F 1/00

[52] U.S. Cl. ..... 335/216; 335/301; 324/318; 174/15.4; 62/51.1

[58] Field of Search ..... 335/216, 301; 324/318, 319, 320; 174/15.4, 15.5, 125.1; 62/51.1, 51.2, 51.3

[56] References Cited

U.S. PATENT DOCUMENTS

| | | | |
|---|---|---|---|
| 3,828,111 | 8/1974 | Berthet . | |
| 4,646,044 | 2/1987 | Kuno et al. . | |
| 4,651,117 | 3/1987 | Kawaguchi et al. . | |
| 4,895,831 | 1/1990 | Laskaris . | |
| 5,056,214 | 10/1991 | Holt | 29/602.1 |

FOREIGN PATENT DOCUMENTS

| | | |
|---|---|---|
| 0350268 | 1/1990 | European Pat. Off. . |
| 2572843 | 5/1986 | France . |
| 3640180 | 6/1988 | Germany . |
| 63-028080 | 2/1988 | Japan . |
| 1-100901 | 4/1989 | Japan . |
| 1-133308 | 5/1989 | Japan . |
| 1-161810 | 6/1989 | Japan . |
| 1-154502 | 6/1989 | Japan . |
| 4-79304 | 3/1992 | Japan . |
| 258103 | 9/1992 | Japan . |

*Primary Examiner*—Lincoln Donovan

*Attorney, Agent, or Firm*—Burns, Doane, Swecker & Mathis, LLP

[57] ABSTRACT

In a superconducting magnet system which has a superconducting coil member, a cryocooler for cooling the superconducting coil member into the superconducting state, and a current lead for supplying an electric current to the superconducting coil member, the current lead is made of a high-temperature superconducting material and is also cooled by the cryocooler into the superconducting state with the current lead kept in contact with the cryocooler.

23 Claims, 21 Drawing Sheets

(a)

(b)

FIG. 26 (a)
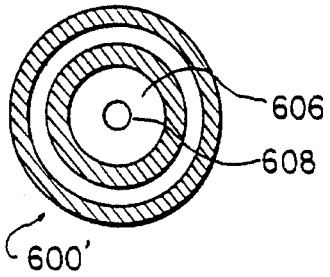
FIG. 26 (b)
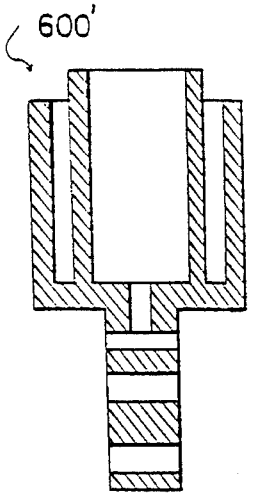
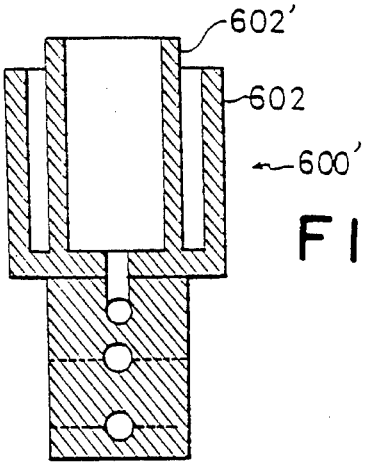
FIG. 26 (c)
FIG. 26 (d)
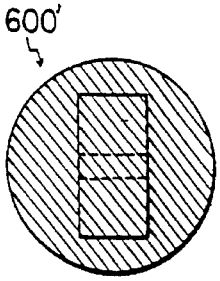

COMPACT SUPERCONDUCTING MAGNET SYSTEM FREE FROM LIQUID HELIUM

BACKGROUND OF THE INVENTION

The present invention relates to a superconducting magnet system which is for use in generating an intense magnetic field in various systems, such as a linear motorcar, a beam accelerator, and in the measurement of the magnetized material characteristics.

In a conventional superconducting magnet system of the type described, coils of magnetic systems were put into a superconducting state by immersing the coil in liquid helium to cool the coils to an extremely low temperature.

However, use of liquid helium renders a running cost high and handling difficult in the conventional superconducting magnet system. This is because the liquid helium is expensive, volatile, and difficult in handling. Further, the conventional superconducting magnet system inevitably becomes bulky in structure, since it needs a liquid helium tank, a liquid helium transfer tube, and the like.

Recently, in order to solve such disadvantages of the conventional superconducting magnet system, a superconducting magnet system which may be free from liquid helium has been proposed by the inventors of the present invention in Japanese Patent Prepublication No. 258103/1992.

The superconducting magnet system mentioned in the above-referenced application comprises a cryocooler which has a cooling stage, a superconducting coil which contacts with the cooling stage, and current leads for supplying an electric current to the superconducting coil. The cooling stage is kept at a predetermined cooling temperature. The superconducting coil is cooled down to the predetermined cooling temperature by the cryocooler. The cryocooler may have an additional cooling stage.

In the superconducting magnet system described in the above-mentioned application, no consideration has been made about the current leads which are used for supplying the electric current to the superconducting coil. In this connection, such current leads are formed by a normal conductive material.

However, when the current leads are formed by a normal conductive material, it has been found out that Joule's heat inevitably generates from the current leads during supply of the electric current to the superconducting coil. The Joule's heat is propagated into the superconducting coil and deteriorates an efficiency of cooling. As a result, a heavy load is imposed on the cryocooler on cooling the superconducting coil.

In order to solve the above-mentioned problem, the current leads may be formed by a high-temperature superconducting material. According to this structure, Joule's heat might not generate from the current leads while the current leads are kept at a superconducting state. However, it becomes necessary to cool the current leads by another cryocooler which is exclusively used therefor. Consequently, the superconducting magnet system inevitably becomes bulky in size and complicated in structure.

The superconducting magnet system mentioned in the above-referenced application has the other disadvantages.

Namely, it takes a long time to cool the superconducting coil from a room temperature to the above-mentioned superconducting state at an extremely low temperature lower than about 77K. In addition, the distribution of the temperature is not uniform in the superconducting coil in the superconducting state.

SUMMARY OF THE INVENTION

It is therefore an object of this invention to provide a compact superconducting magnet system which can efficiently cool the superconducting coil without liquid helium.

It is another object of this invention to provide a superconducting magnet system of the type described, which does not take a long time to cool the superconducting coil from room temperature into the superconducting state and which can make the distribution of the cooled temperature uniform in the superconducting coil.

It is still another object of this invention to provide a superconducting current lead for use in a superconducting magnet system of the type described, which is not easily destroyed by a thermal stress or an external force even when the superconducting current lead is substantially made of oxide ceramics.

It is a further object of this invention to provide an oxide superconducting current lead for use in a superconducting magnet system of the type described, in which an electrode formed on each end of the oxide superconducting conductor is tightly adhered to the oxide superconducting conductor.

It is a still further object of this invention to provide a superconducting current lead for use in a superconducting magnet system of the type described, in which a terminal for the superconducting current lead is readily coupled to the superconducting current lead.

Other objects of this invention will become clear as the description proceeds.

According to an aspect of this invention, an improved superconducting magnet system is provided. The superconducting magnet system comprises a cryocooler which has a cooling stage cooled down to a predetermined temperature, a superconducting coil member which is kept in contact with the cooling stage to thereby be cooled down to the predetermined temperature by the cryocooler, and a current lead of a high-temperature superconducting material having first and second end portions for supplying an electric current to the superconducting coil member with the current lead kept in contact with the cooling stage.

According to another aspect of this invention, another superconducting magnet system is provided. The superconducting coil member comprises a coil bobbin and a superconducting wire wound around the coil bobbin. The superconducting magnet system further comprises cooling promoting means surrounding the superconducting wire for promoting the cooling of the superconducting wire, with both the superconducting coil member and the cooling promoting means kept in contact with the cooling stage.

According to still another aspect of this invention, an improved current lead for use in supplying an electric current to a superconducting magnet is provided. The current lead comprises a conductor portion of ceramics having two ends and high temperature superconductivity, a pair of electrodes which are formed on each end of the conductor portion, and a resin layer which is coated on the conductor portion and the electrodes.

According to a further aspect of this invention, another current lead for use in supplying an electric current to a superconducting magnet is provided. The current lead comprises a cylindrical conductor portion which has a cylindrical wall having a first predetermined thickness and which surrounds a prismal space therein, the cylindrical conductor portion being made of an oxide high-temperature superconducting material, an electrode forming portion of a second predetermined thickness which is defined on the cylindrical conductor portion and which has at least one groove having a predetermined depth and a predetermined width, and an electrode which is formed on the electrode forming portion by depositing a metallic compound including silver powder of a predetermined particle size.

According to a still further aspect of this invention, an improved terminal for a current lead which is for use in connecting an electric wiring with electrodes each of which is formed on each end of a cylindrical conductor portion is provided. The terminal comprises a terminal portion which has a cup-like configuration of which an inner diameter is larger than an outer diameter of the electrodes.

DESCRIPTION OF THE PREFERRED EMBODIMENTS

Figure 1:
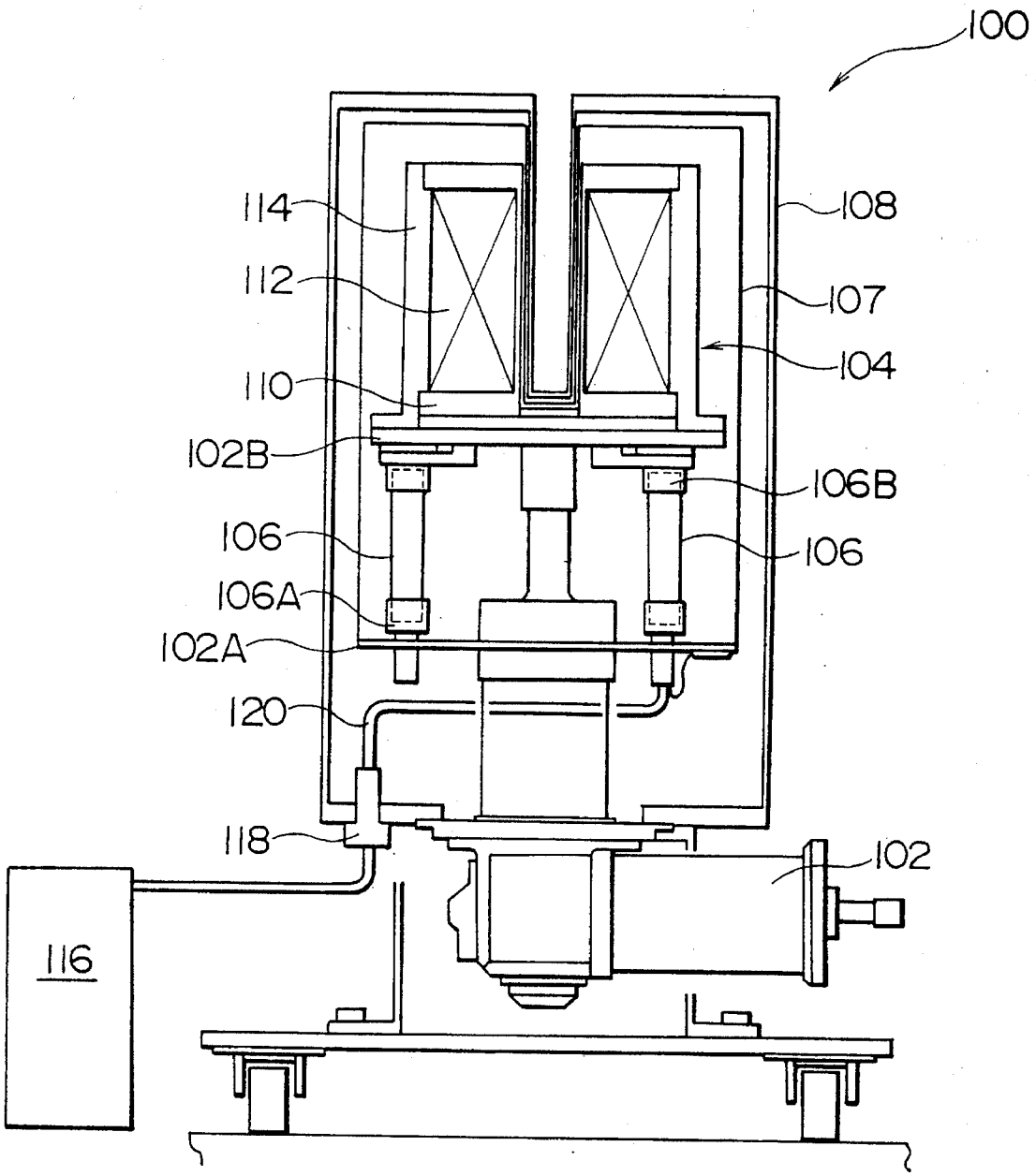
FIG. 1 is a partial vertical sectional view of a superconducting magnet system according to a first embodiment of this invention.

Referring to FIG. 1, a superconducting magnet system 100 comprises a cryocooler 102, a first cooling stage 102A, and a second cooling stage 102B. The first cooling stage 102A is cooled down to a first predetermined temperature of, for example, 77K while the second cooling stage 102B is cooled down to a second predetermined temperature between 4K and 10K lower than the first predetermined temperature.

The superconducting magnet system 100 further comprises a superconducting coil member 104, a pair of current leads 106, and a thermal shielding plate 107. The superconducting coil member 104 is brought into contact with the second cooling stage 102B and thereby cooled down to the second predetermined temperature. Each of the pair of the current leads 106 supplies an electric current to the superconducting coil member 104 and has first and second ends 106A and 106B directed downwards and upwards of FIG. 1. Each current lead 106 is brought into contact with both the first cooling stage 102A and the second cooling stage 102B at the first and the second ends 106A and 106B, respectively. The thermal shielding plate 107 is kept in contact with the first cooling stage 102A and prevents the superconducting coil member 104 and the current leads 106 from being subjected to a heat.

The first and the second cooling stages 102A and 102B, the superconducting coil member 104, the current leads 106, and the thermal shielding plate 107 are contained in a cryostat 108.

It is to be noted in the illustrated example that each of the current leads 106 is formed by a high-temperature superconducting material of, for example, a Bi-based oxide.

The superconducting coil member 104 substantially consists of a coil bobbin 110 and a superconducting wire 112 wound around the coil bobbin 110. The superconducting wire 112 is covered by a copper block 114 which is effective to cool the superconducting wire 112. The coil bobbin 110 and the copper block 114 are brought into contact with and fixed to the second cooling stage 102B. With this structure, the superconducting wire 112 can be efficiently cooled down to the second predetermined temperature, namely, a very low temperature, between 4K and 10K.

The current leads 106 are connected to an external power supply 116 through a current lead terminal 118 and a current lead wire 120 which may have normal conductivity. The first end 106A of each current lead 106 is thermally coupled to the first cooling stage 102A while the second end 106B of each current lead 106 is thermally coupled to the second cooling stage 102B.

In the above-mentioned superconducting magnet system according to the first embodiment of this invention, each current lead 106 is composed of the high-temperature superconducting material, as mentioned before, and is therefore put into a superconducting state when it is cooled down to the first predetermined temperature, namely, 77K together with the first cooling stage 102A. In this event, Joule's heat is not generated from the current leads 106 and the superconducting coil member 104, even when an electric current is caused to flow through the current leads 106. This is because both the current leads 106 are put into the superconducting state together with the superconducting coil member 104.

Figure 2:
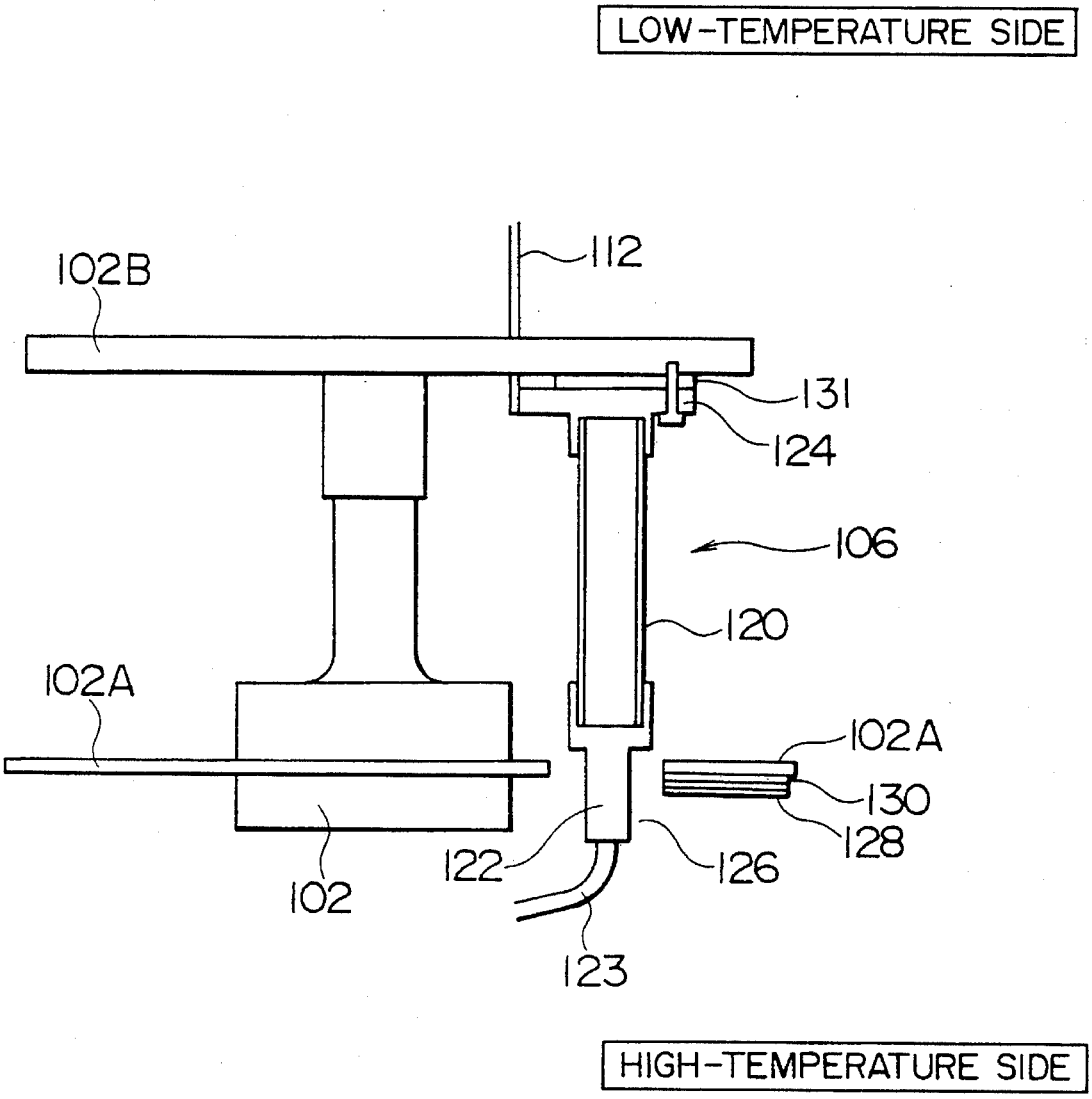
FIG. 2 is an elongated sectional view of a high-temperature superconducting current lead in the superconducting magnet system illustrated in FIG. 1.

Referring now to FIG. 2, description is made about a structure for fixing the current leads 106 to both the first and the second cooling stages 102A and 102B which may be located on high and low temperature sides of the superconducting magnet system, respectively.

In the illustrated example, each current lead 106 comprises a current lead bulk 120, a first electrode 122 located on the high temperature side, a second electrode 124 placed on the low temperature side.

The current lead bulk 120 is made of a high-temperature oxide superconducting material which is put into the superconducting state, when cooled down to about 70K or so. The high temperature side of the current lead bulk 120 is brazed by solder to one end of the first electrode 122 that is not fixedly supported and which therefore has a free end on the high temperature side. The low temperature side of the current lead bulk 120 is brazed by solder to the second electrode 124.

On the high temperature side, the first electrode 122 is connected to the current lead wire 123 of the normal conductivity and is also connected to the first cooling stage 102A by way of a heat anchor copper wire 126, a copper plate 128, and an insulator 130 which may be formed, for example, by a plate of aluminum nitride.

On the low temperature side, the second electrode 124 is not only connected to the second cooling stage 102B by way of an insulator 131 which may be formed, for example, by a plate of aluminum nitride but also fixed thereto by a bolt to form a fixed end. The second electrode 124 is also electrically connected to the superconducting wire 112 of the superconducting coil member 104 (FIG. 1).

With this structure, it is possible to prevent a thermal stress imposed on the current lead 106 because the current lead 106 is fixed nowhere and provides the free end on the high temperature side.

Besides, the low temperature side of the current lead 106 is cooled down to the second predetermined temperature, such as 4K to 10K by conduction cooling and kept at such an extremely low temperature, since the current lead 106 is closely contacted with the second cooling stage 102B which is cooled down to the second predetermined temperature.

As mentioned before, the current lead 106 forms the free end on the high temperature side and is not directly connected to the first cooling stage 102A of the cryocooler 102. As a result, the current lead 106 is cooled down to the first predetermined temperature of about 70K on the high temperature side, because the current lead 106 is thermally contacted with the first cooling stage 102A through the above-mentioned heat anchor copper wire 126.

As mentioned above, in the first embodiment of the present invention, electric power or the electric current is supplied to the current lead 106 on condition that the current lead bulk 120 is kept below the first predetermined temperature and put in the superconducting state. This means that the current lead 106 has an extremely low electric resistance. Therefore, a very low load is imposed on the cryocooler 102 in cooling the superconducting coil member 104 in comparison with the conventional superconducting magnet system mentioned in the preamble of the instant specification. As a result, it becomes unnecessary to use a plurality of cryocoolers. Furthermore, the superconducting magnet system illustrated in FIGS. 1 and 2, as a whole, becomes compact in structure.

Figure 3:
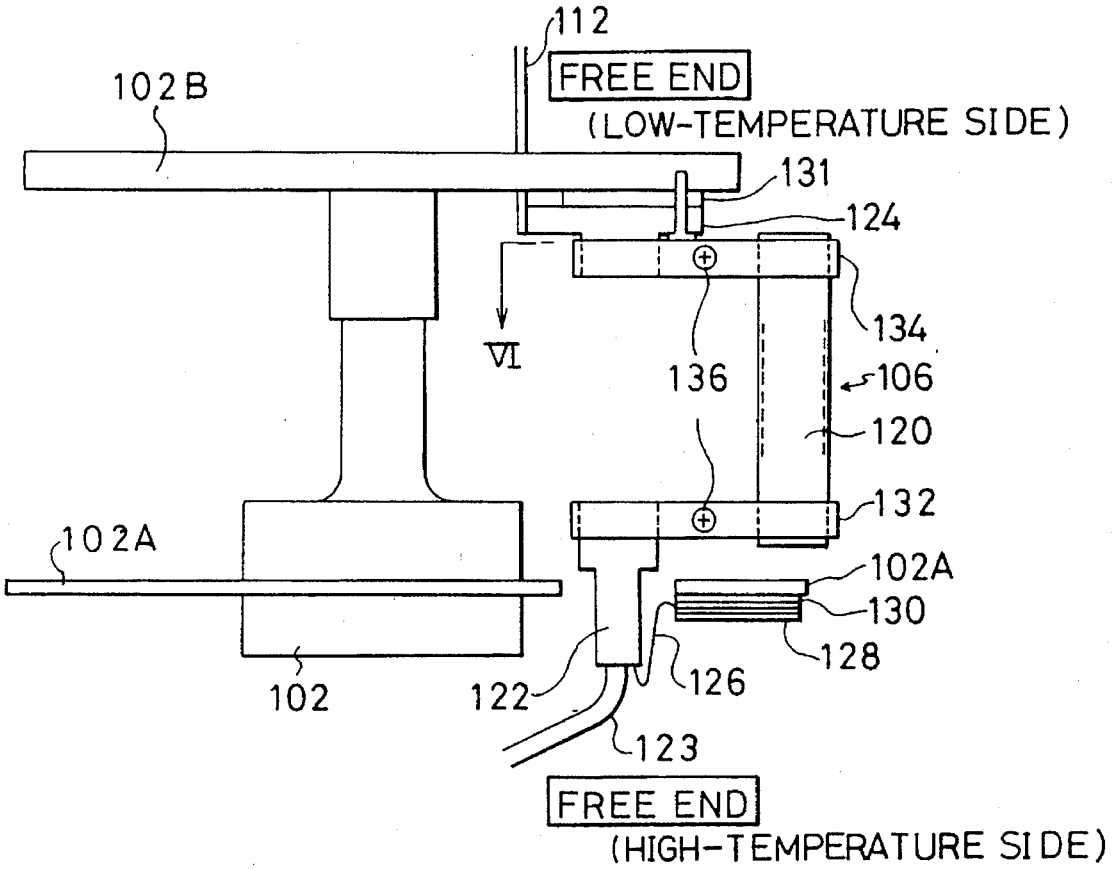
FIG. 3 is an elongated sectional view of a high-temperature superconducting current lead of a superconducting magnet system according to a second embodiment of this invention.
Figure 4:
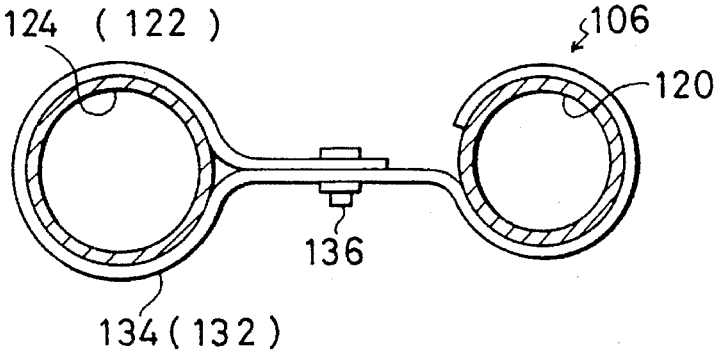
FIG. 4 is a partial horizontal sectional view of a high-temperature superconducting current lead illustrated in FIG. 3, which is seen in the direction of VI line.

Referring to FIGS. 3 and 4, description will proceed to a superconducting magnet system according to a second embodiment of this invention. The superconducting magnet system according to the second embodiment has a structure similar to that of the first embodiment except that the current lead 106 and electrodes contacted with the current lead 106 are somewhat different from those illustrated in FIG. 2.

As illustrated in FIGS. 3 and 4, the electrodes depicted at 132 and 134 are located on the high and the low temperature sides, respectively. Each of the electrodes 132 and 134 is similar in structure to each other, as illustrated in FIG. 4. As shown in FIG. 4, each of the electrodes 132 and 134 is formed by a flexible material and defines a pair of circles therein. The current lead 106 is formed by a superconductive material and has first and second end portions placed on the high and the low temperature sides, respectively. The first end portion of the current lead 106 is inserted into one of the two circles of the flexible circular electrode 132 and fixed thereto by solder, while the second end portion of the current lead 106 is inserted into the corresponding one of the two circles of the electrode 134 and fixed thereto by solder.

On the high temperature side, a first connection electrode 122 is inserted into another one of the two circles of the electrode 132, while a second connection electrode 124 is inserted on the low temperature side into another one of the two circles of the electrode 134. Each of the electrodes 132 and 134 is fastened by a bolt 136.

Besides, each electrode 132 and 134 is made of a thin copper plate shaped into the configuration illustrated in FIG. 4.

With this structure, the current lead 106 is free from a thermal stress, since both the first and the second end portions of the current lead 106 form free ends, as illustrated in FIGS. 3 and 4.

Figure 5:
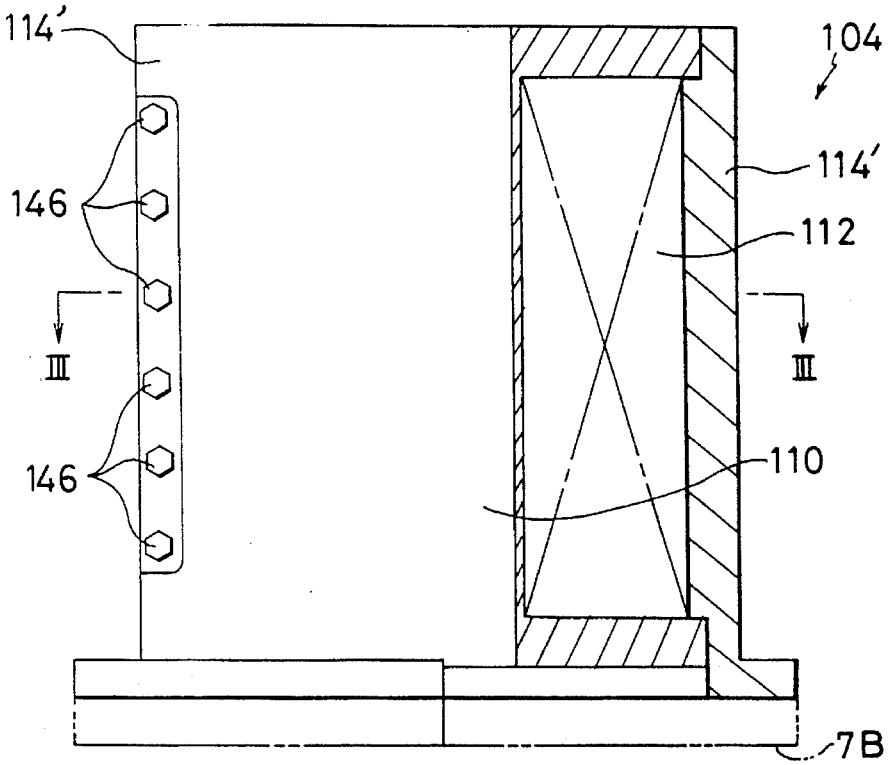
FIG. 5 is an elongated sectional view of a copper block for cooling a circumference of the superconducting coil in a superconducting magnet system according to a third embodiment of this invention.
Figure 6:
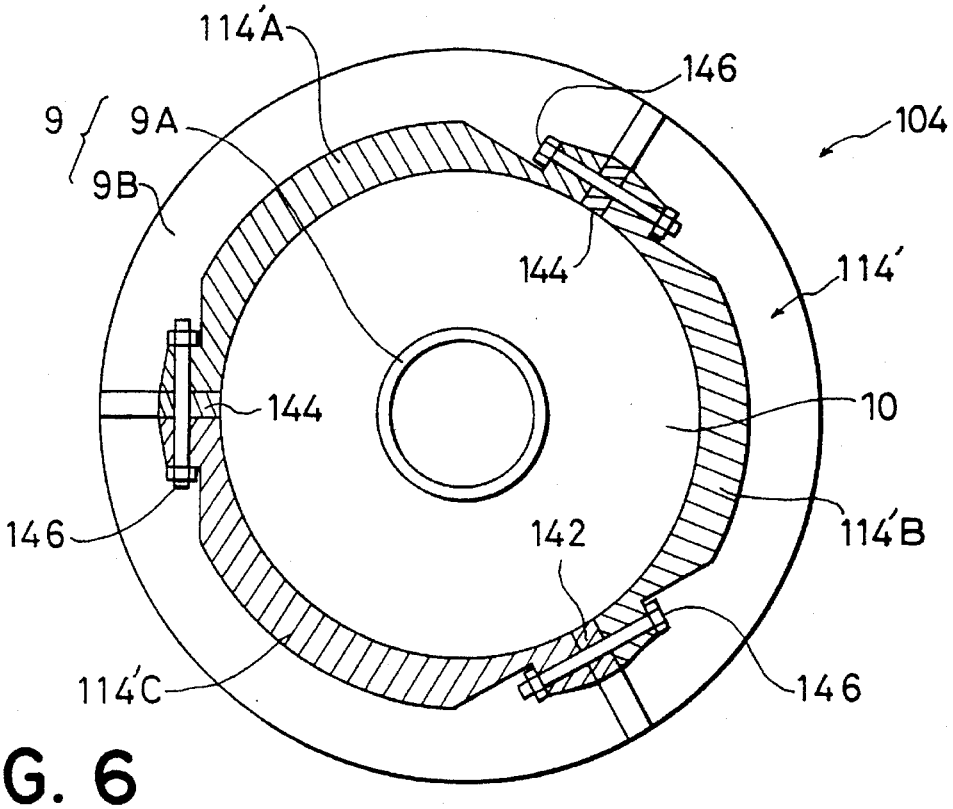
FIG. 6 is a partial horizontal sectional view of a copper block illustrated in FIG. 5, which is seen in the direction of III—III line.

Referring now to FIGS. 5 and 6, description is made about a superconducting magnet system according to a third embodiment of this invention.

The superconducting magnet system according to the third embodiment has a structure similar to that of the first or the second embodiment except for the followings. Similar portions are designated by like reference numerals.

In the example illustrated in FIGS. 5 and 6, a copper block 114' surrounds the superconducting wire 112 to cool the superconducting wire 112 from an outer periphery thereof and is composed of three segments 114'A, 114'B, and 114'C.

Between two adjacent ones of the segments 114'A, 114'B, and 114'C, three spacers are inserted at least one of which is an insulator 142 and the remaining one or ones of which may be a copper sheet 144. The insulator 142 serves for preventing an eddy current flowing through the copper block 114'. The segments 114'A, 114'B, and 114'C are fastened to one another in the direction of a center of the superconducting coil member 104 by the use of bolts 146 to increase a thermal conductivity of the copper block 114' by enhancing a tight adherence of each other. The tight adherence may be adjusted by the use of shims in addition to the insulator 142 or the copper sheet 144.

Alternatively, a low-temperature grease which has an excellent thermal conductivity may be filled between the copper block 114' and the superconducting wire 112 which is coated with an insulating film.

In the above-described superconducting magnet system according to the third embodiment of this invention, thermal conduction in the superconducting coil member 104 is efficiently conducted not only from the coil bobbin 110 but also from the copper block 114'. As a result, it does not take a long time to cool the superconducting coil member from a room temperature (300K) to the superconducting state. In addition, this structure is effective to make the distribution of the temperature uniform in the superconducting coil member.

Figure 7:
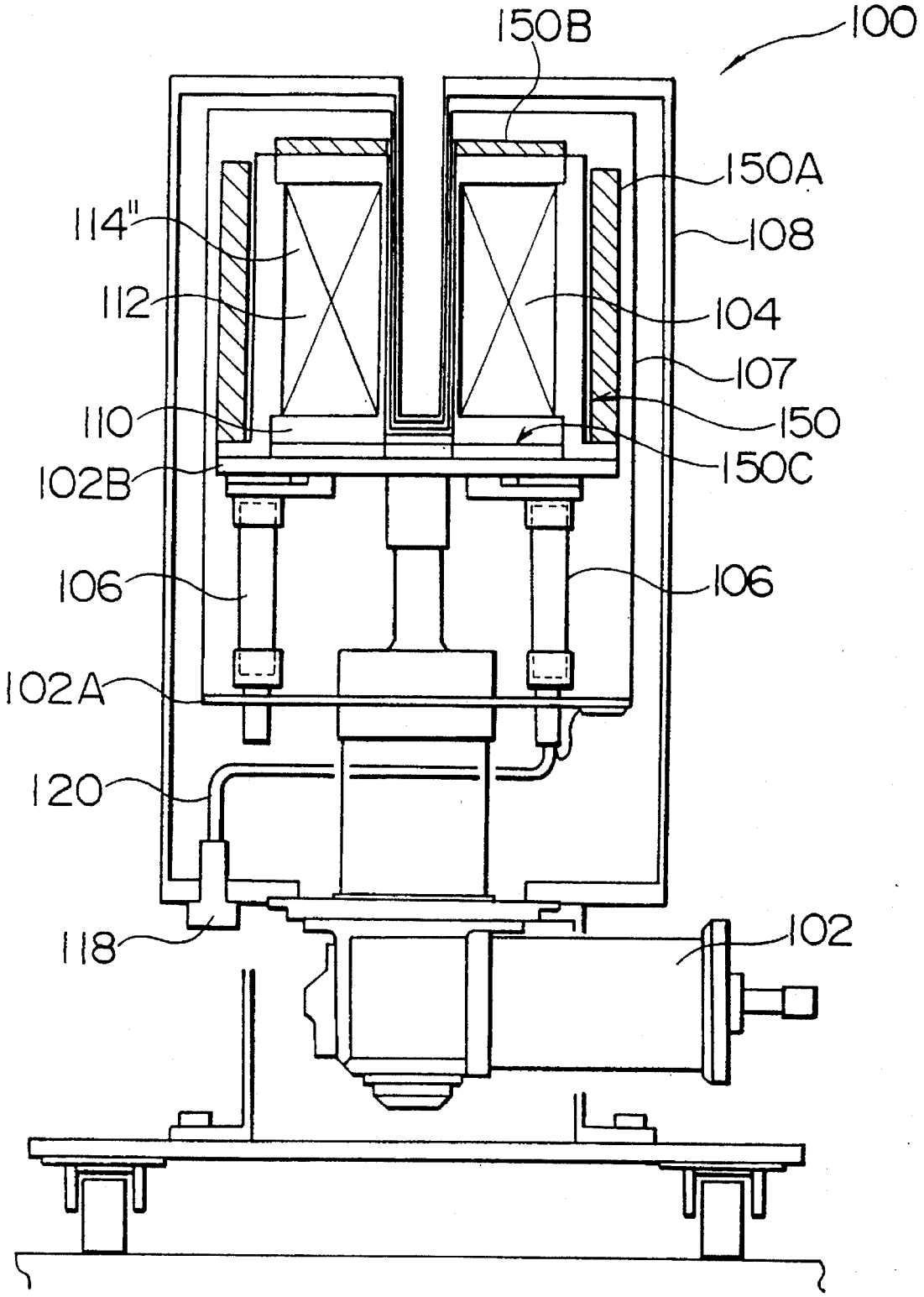
FIG. 7 is a partial vertical sectional view of a superconducting magnet system according to a fourth embodiment of this invention.
Figure 8:
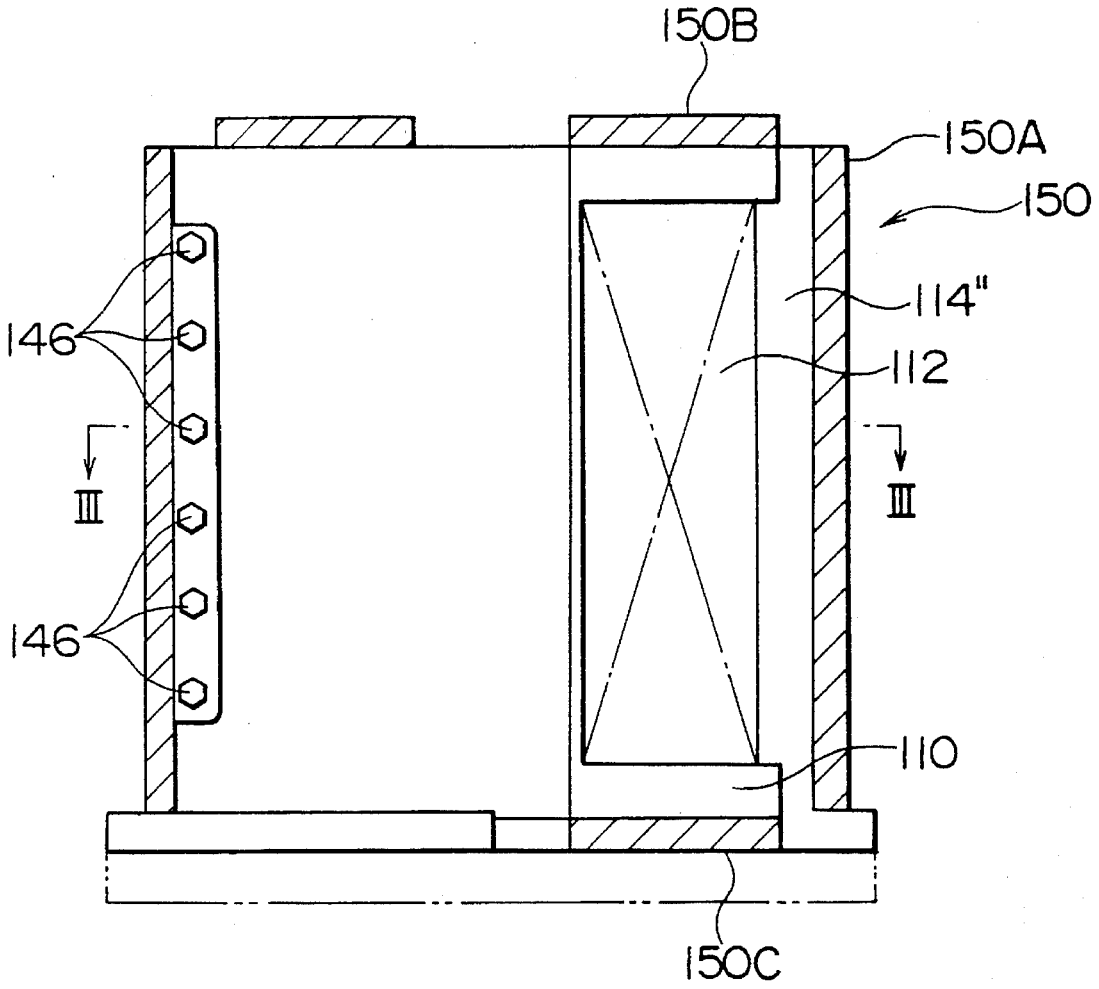
FIG. 8 is an elongated sectional view of a copper block for cooling a circumference of the superconducting coil in the superconducting magnet system illustrated in FIG. 7.
Figure 9:
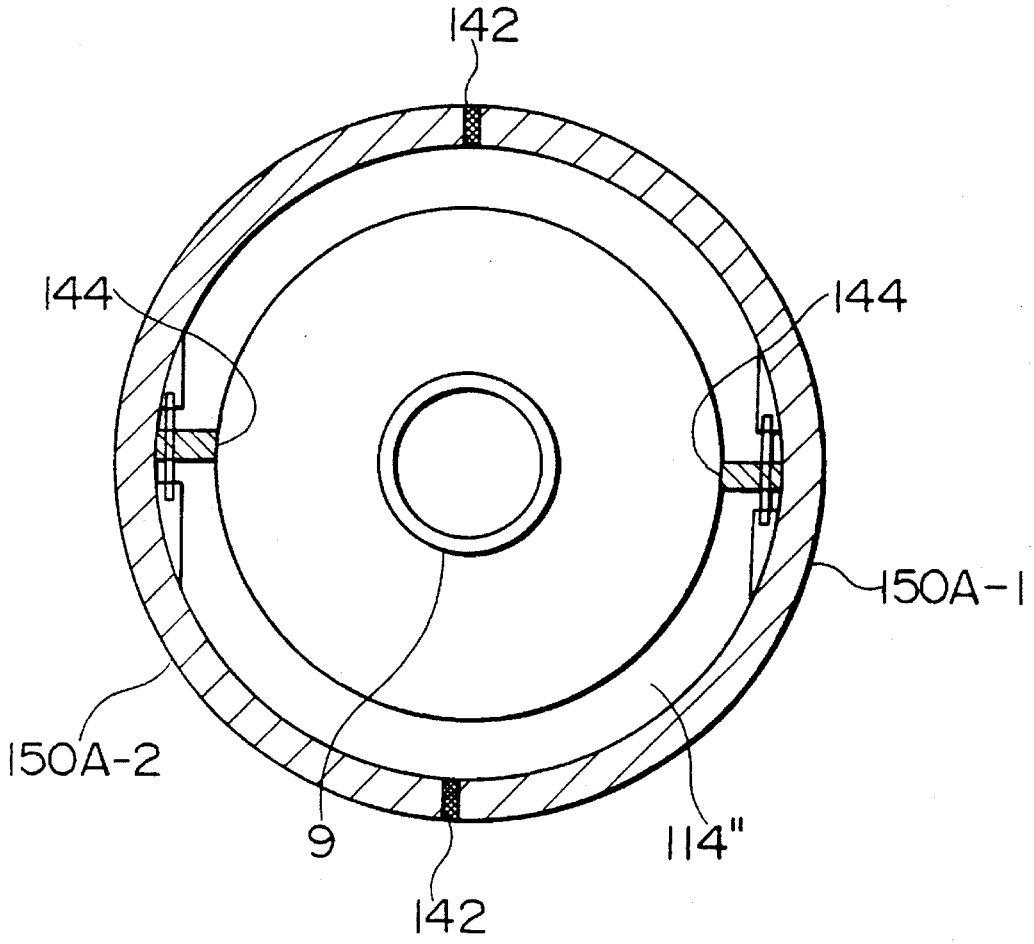
FIG. 9 is a partial horizontal sectional view of a copper block illustrated in FIG. 8, which is seen in the direction of III—III line.

Referring to FIGS. 7, 8, and 9, description will proceed to a superconducting magnet system according to a fourth embodiment of this invention.

The superconducting magnet system has a structure similar to that of the third embodiment except for the followings. Similar portions are designated by like reference numerals.

As illustrated in FIGS. 7, 8, and 9, the superconducting coil member 104 is surrounded by a magnetic shield unit 150 formed by a material comprising iron. In the illustrated example, the magnetic shield unit 150 is made of permalloy but may be alternatively made of pure iron.

The magnetic shield unit 150 comprises a cylindrical magnetic shield element 150A which is positioned around the copper block 114", an upper toroidal magnetic shield element 150B which is mounted on a top of the coil bobbin 110, and a lower toroidal magnetic shield element 150C which is situated under a bottom of the coil bobbin 110. The cylindrical magnetic shield element 150A is composed of two segments 150A-1 and 150A-2 (as illustrated in FIG. 9).

In the superconducting magnet system according to the fourth embodiment of this invention, the superconducting coil member 104 is surrounded by the magnetic shield unit 150, as mentioned before. It is possible to prevent a leakage flux of the superconducting coil member 104 from deteriorating a critical current of the current lead 106 of an oxide high temperature superconducting material.

Besides, the magnetic shield unit 150 serves to avoid disturbance of distribution of flux generated by the superconducting coil member 104, since the magnetic shield unit 150 has the upper magnetic shield element 150B and the lower magnetic shield element 105C (as shown in FIG. 7) both of which have the same toroidal configuration and which are positioned symmetrically on the upper and the lower sides of the superconducting coil member 104.

Figure 10:
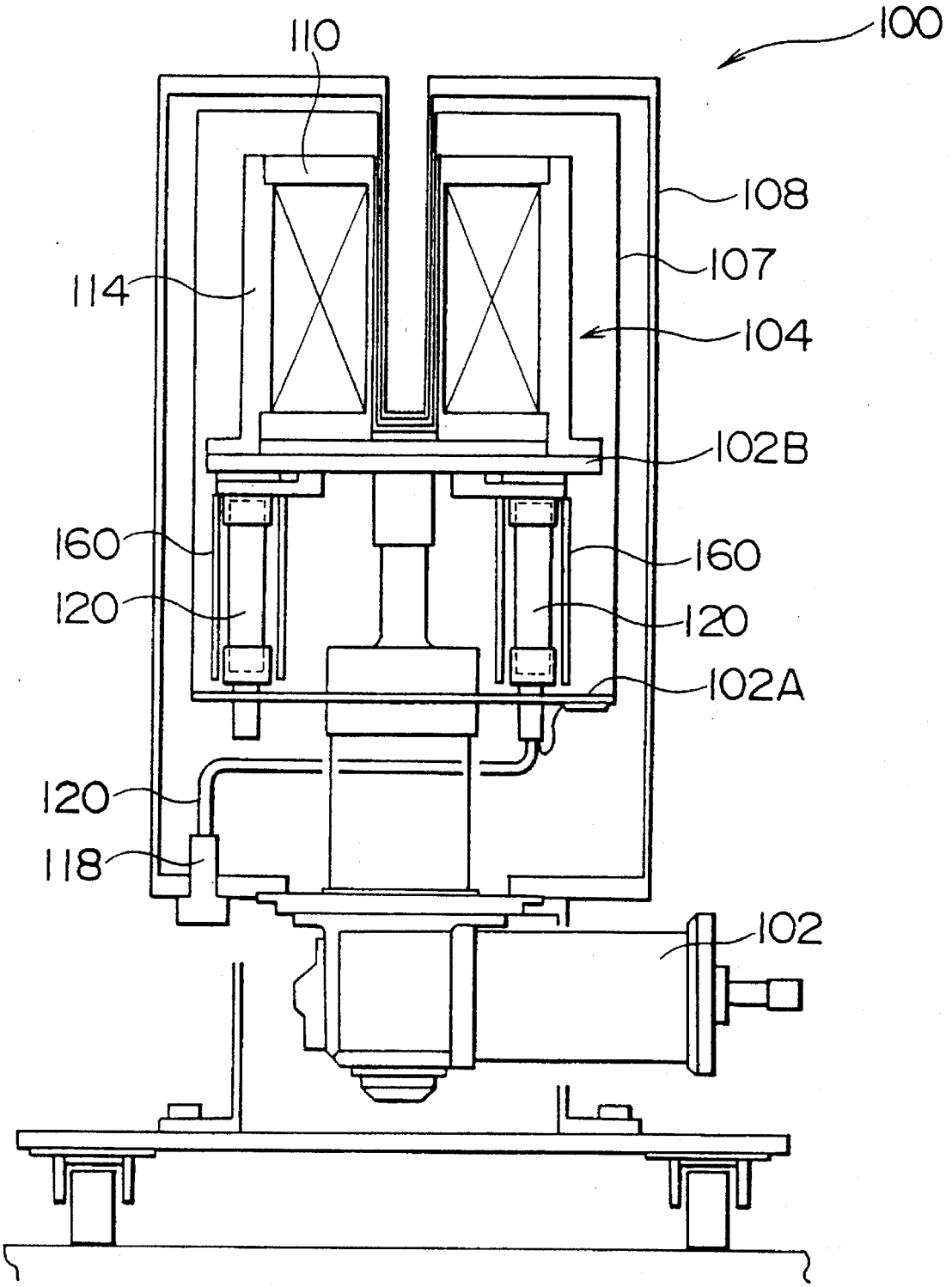
FIG. 10 is a partial vertical sectional view of a superconducting magnet system according to a fifth embodiment of this invention.

Referring now to FIG. 10, description will proceed to a superconducting magnet system according to a fifth embodiment of this invention.

The superconducting magnet system has a structure similar to that of the third embodiment except for the followings. Similar portions are designated by like reference numerals.

As illustrated in FIG. 10, the superconducting magnet system may not have the magnetic shield unit 150 (shown in FIGS. 7, 8, and 9) but has cylindrical magnetic shields 160 each of which surrounds each current lead bulk 120, respectively.

The magnetic shields 160 are made of a superconductive material, such as an oxide high temperature superconductive material. Alternatively, the magnetic shields 160 may be made of a metallic superconductive material, such as NbTi and the like.

Thus, the current lead bulk 120 is surrounded by the cylindrical magnetic shield 160 of superconductivity. It is therefore effective to favorably and considerably reduce an external magnetic field imposed on the current lead bulk 120. As a result, it can be prevented that a leakage flux from the superconducting coil member 104 deteriorates a critical current of the current lead bulk 120, even when the current lead bulk 120 is made of an oxide high temperature superconducting material.

Besides, the cylindrical magnetic shield 160 can be cooled down to an extremely low temperature of, for example, not higher than 5K by the contact with the second cooling stage 102B. With this structure, the cylindrical magnetic shield 160 can be kept at a temperature lower than a critical temperature of the superconductive material (for example, 9.8K in a case of NbTi).

Figure 11:
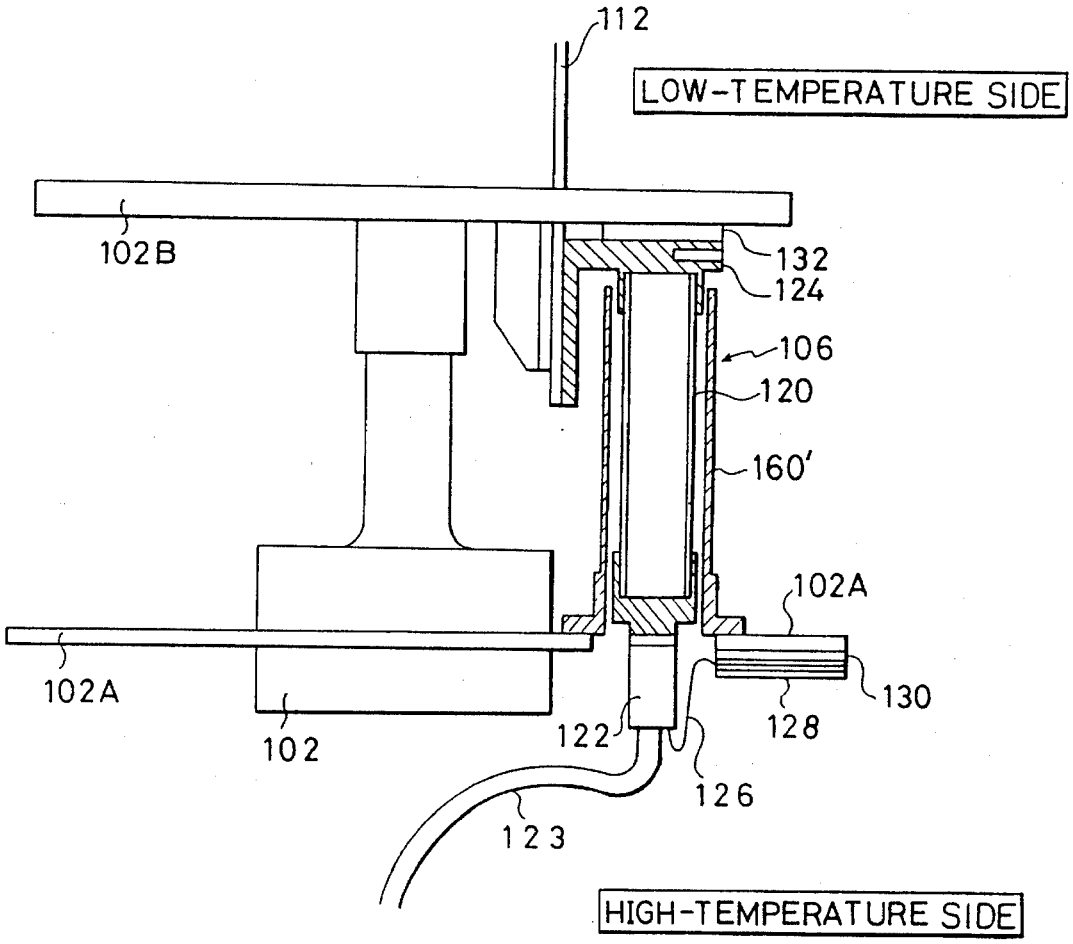
FIG. 11 is an elongated sectional view of a cylindrical magnetic shield according to a modification of the superconducting magnet system illustrated in FIG. 10.

The cylindrical magnetic shields 160 illustrated in FIG. 10 may be modified in FIG. 11.

As illustrated in FIG. 11, the cylindrical magnetic shields 160' (one of which is not shown) extend from the first cooling stage 102A to surround each current lead bulk 120.

The cylindrical magnetic shields 160' are made of a high-temperature superconducting material. The cylindrical magnetic shields 160' can be cooled down to the low temperature of, for example, 77K by the contact with the first cooling stage 102A.

Figure 12:
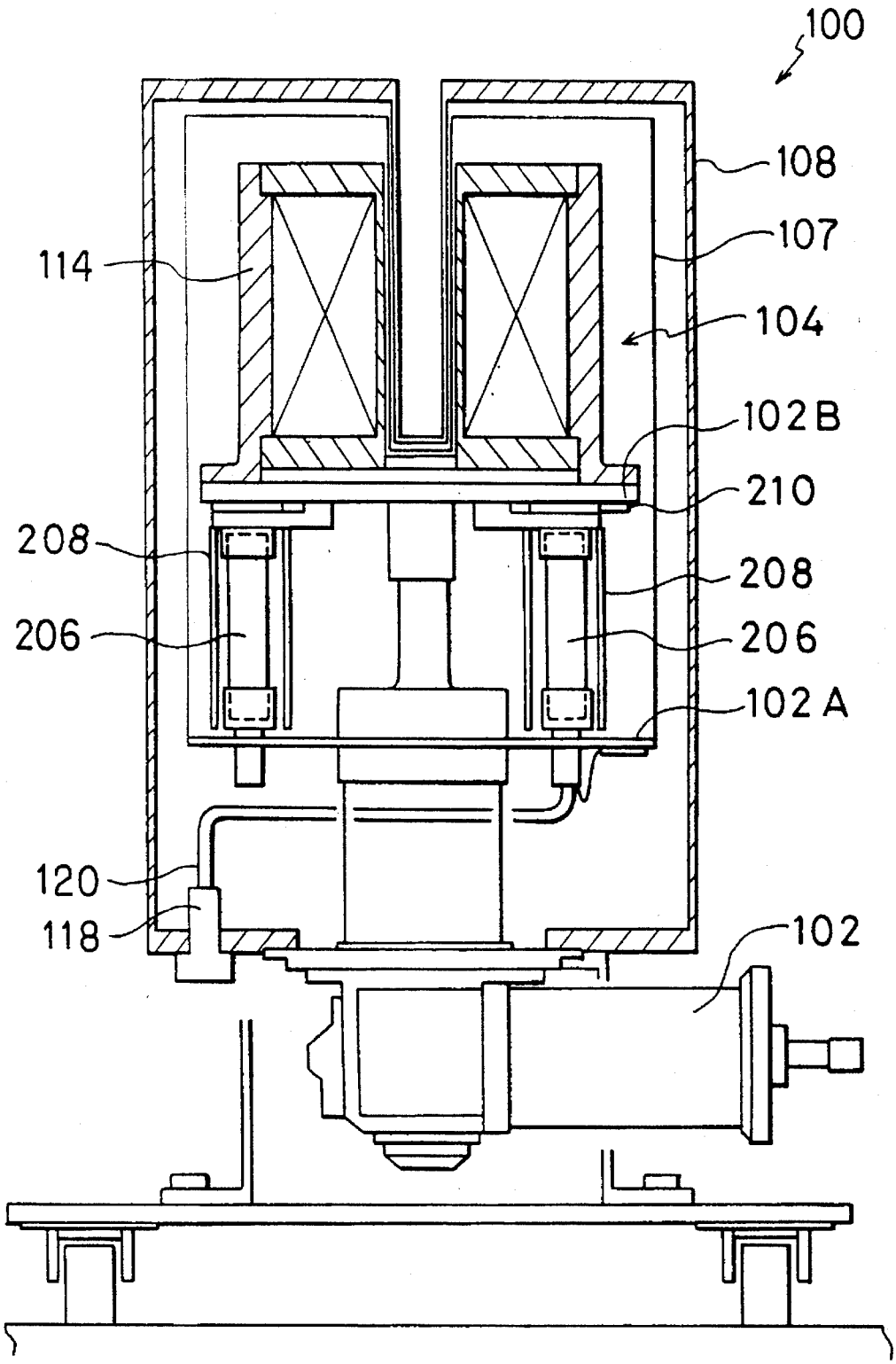
FIG. 12 is a partial vertical sectional view of a superconducting magnet system according to a sixth embodiment of this invention.
Figure 13:
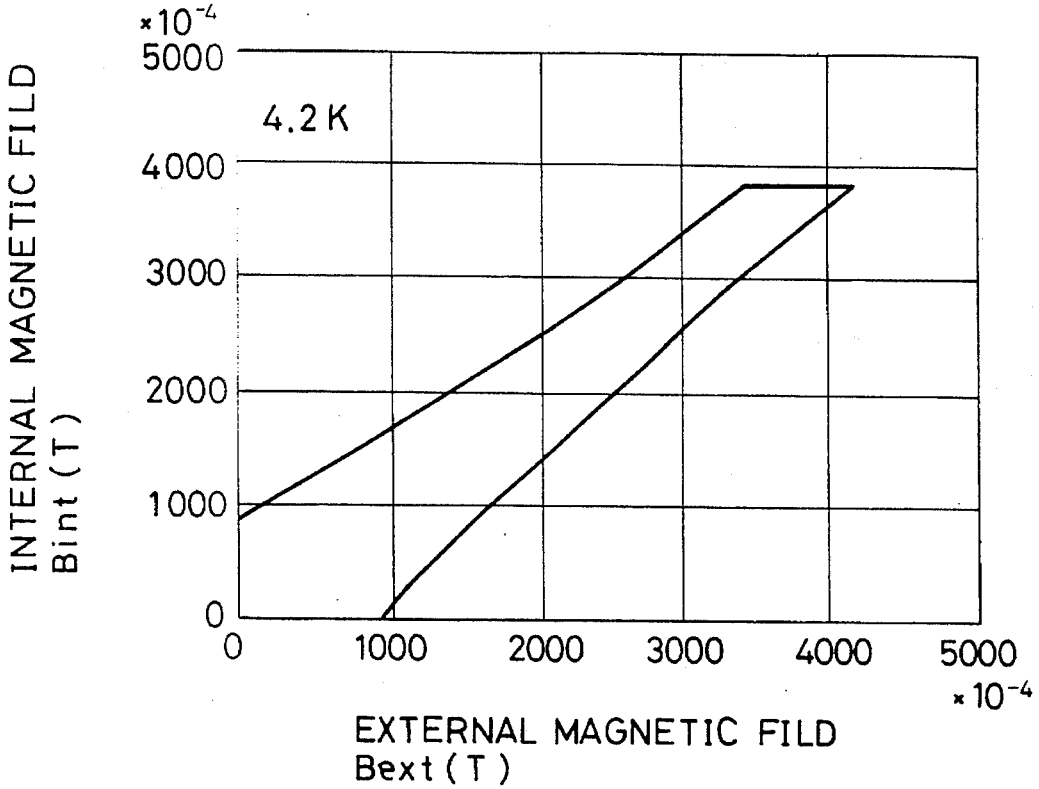
FIG. 13 is a graphical representation for use in describing a relationship between an external magnetic field and an internal magnetic field in the high-temperature superconducting magnetic shield of the superconducting magnet system illustrated in FIG. 12, which is cooled down to 4.2K.
Figure 14:
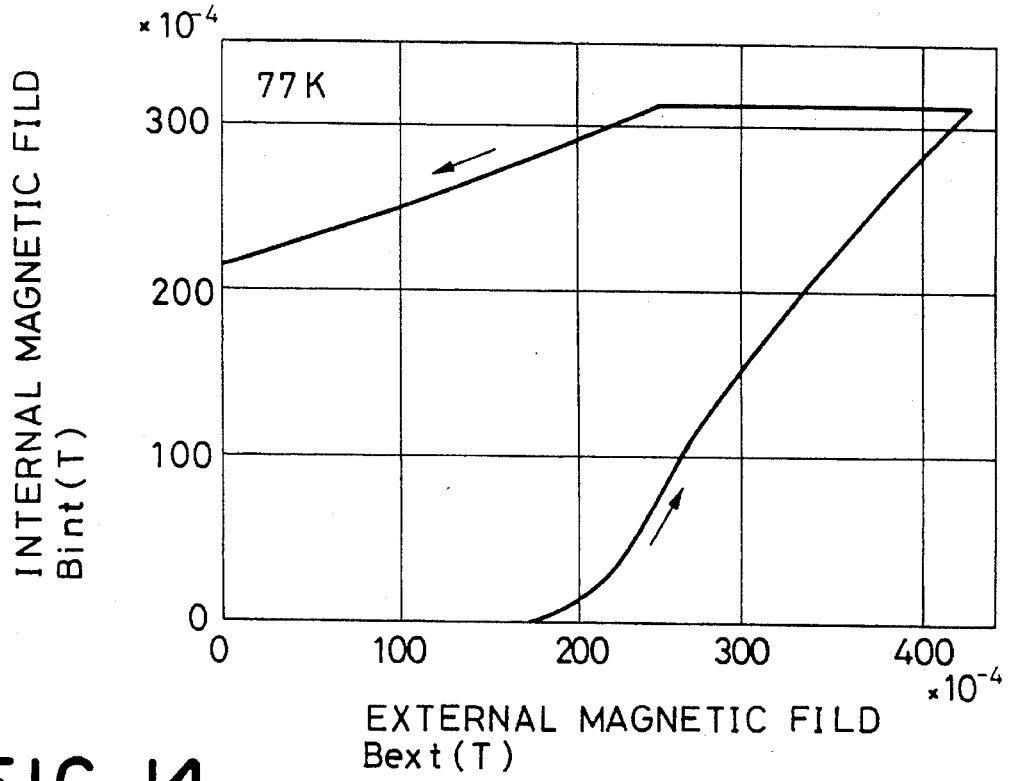
FIG. 14 is a graphical representation for use in describing a relationship between an external magnetic field and an internal magnetic field in the high-temperature superconducting magnetic shield of the superconducting magnet system illustrated in FIG. 12 which is cooled down to 77K.

Referring to FIGS. 12, 13, and 14, description will proceed to a superconducting magnet system according to a sixth embodiment of this invention.

The superconducting magnet system according to the sixth embodiment has a structure similar to that of the fifth embodiment except for the followings. Similar portions are designated by like reference numerals.

As illustrated in FIG. 12, the superconducting magnet system comprises a cryocooler 102, a first cooling stage 102A of a first predetermined temperature and a second cooling stage 102B of a second predetermined temperature lower than the first predetermined temperature. Like in FIG. 1, a superconducting coil member 104 is brought into contact with the second cooling stage 102B to thereby be cooled to the second predetermined temperature lower than the first predetermined temperature by the cryocooler 102. In addition, a pair of current leads 206 are included in the illustrated example to supply an electric current to the superconducting coil member 104 and is electromagnetically shielded by a pair of magnetic shield portions 208. Each of the magnetic shield portions 208 is composed of a high-temperature superconducting material and surrounds each of the current leads 206. As shown in FIG. 12, the current leads 206 are kept in contact with the second cooling stage 102B. Each magnetic shield portion 208 is fixed to an insulating member 210 on the low temperature side.

In this embodiment, the magnetic shield portions 208 are cooled to an extremely low temperature by thermal conduction, since each magnetic shield portion 208 is brought into contact with the second cooling stage 102B. Consequently, the magnetic shield portions 208 protect the current leads 206 from the external magnetic field.

In the interim, each of the magnetic shield portions 208 may be composed of a usual superconducting material other than the above-mentioned high-temperature superconducting material. Thus, according to the example illustrated in FIG. 12, both the usual and the high-temperature superconducting materials can be used as a material of the magnetic shield portions 208, since the magnetic shield portions 208 can be cooled not only down to the low temperature of, for example, 77K but also down to the extremely low temperature of, for example, not higher than 5K by the contact with the second cooling stage 102B. Preferably, the magnetic shield portions 208 should be composed of the high-temperature superconducting material, since the magnetic shield portions 208 of such a material can provide an excellent shield effect, compared with the magnetic shield portions 208 of the usual superconducting material, as mentioned below.

Referring now to FIGS. 13 and 14, description is made about magnetic shield characteristics of the magnetic shield portions 208.

As shown in FIG. 13, the magnetic shield portions 208 can succeed in shielding the external magnetic field completely at the point of 0.091 T, when cooled to 4.2K.

On the other hand, as shown in FIG. 14, the magnetic shield portions 208 can shield the external magnetic field completely at the point of 0.016 T, when cooled to 77K. Thus, when cooled to 4.2K, the magnetic shield portions 208 provide a shield effect equal to six times that of 77K.

Each magnetic shield portion 208 may be composed of an oxide high-temperature superconducting material and a heat-conductive metal. The heat-conductive metal may be selected from a group consisting of copper, silver, and aluminum.

Figure 15:
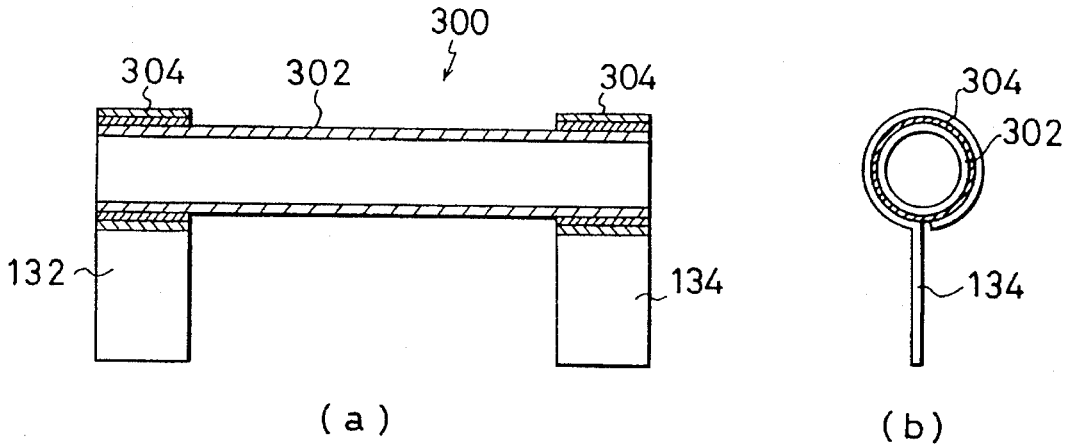
FIGS. 15(*a*) and (*b*) are sectional views of a superconducting current lead according to a seventh embodiment of this invention, which have not yet been molded, (a) is a vertical sectional view, and (b) is a horizontal sectional view.
Figure 16:
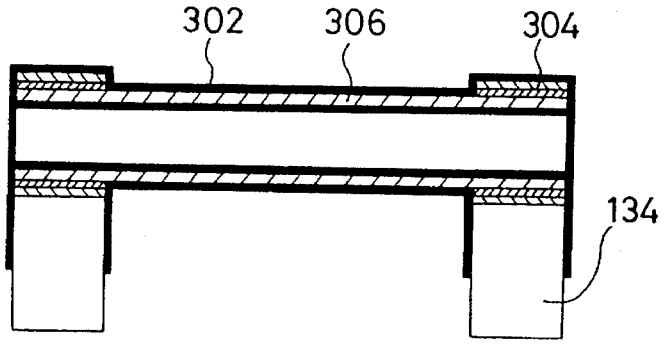
FIG. 16 is a vertical sectional view of a superconducting current lead according to the seventh embodiment of this invention, which has already been molded.

Referring now to FIGS. 15 and 16, description will proceed to a superconducting current lead according to a seventh embodiment of this invention. The superconducting current lead is for use in supplying an electric current to a superconducting magnet.

As illustrated in FIGS. 15 and 16, the superconducting current lead 300 comprises a conductor portion 302 of ceramics, a pair of electrodes 304 which are formed on both ends of the conductor portion 302, and a resin layer 306 (FIG. 16) which is coated or molded on the conductor portion 302 and a part of each of a pair of the electrodes 304. The resin layer 306 preferably includes ceramic powder.

In the above-described superconducting current lead, as mentioned before, the conductor portion 302 and a part of each of a pair of the electrodes 304, 304 are covered by the resin layer 306. As a result, the superconducting current lead 300 is not easily destroyed by external force, even though the superconducting current lead 300 is made of brittle ceramics. Furthermore, thermal-expansion coefficient of the resin layer 306 becomes substantially equal to that of the conductor portion 302 of ceramics, since the resin layer 306 includes ceramic powder. Consequently, no thermal stress takes place in the superconducting current lead 300.

Referring to FIGS. 17 to 23, description will proceed to an oxide high-temperature superconducting current lead according to an eighth embodiment of this invention. The oxide high-temperature superconducting current lead is for use in supplying an electric current to a superconducting magnet, like in the other embodiments.

As illustrated in FIGS. 17 to 23, an oxide high-temperature superconducting current lead 400 comprises a cylindrical conductor portion 402 which has a first predetermined thickness, an electrode forming portion 404 of a second predetermined thickness which is defined within the cylindrical conductor portion 402 and which has a groove 406 (FIG. 18) of a predetermined depth and a predetermined width, and an electrode 408 which is formed on the electrode forming portion 404 by a metallic spray which uses silver powder each of which has a predetermined particle size depicted at $W_D$.

The cylindrical conductor portion 402 is made of a sintered oxide high-temperature superconducting material of bismuth oxide. Each electrode of silver is deposited on the electrode forming portion 404 by spraying.

Figure 18:
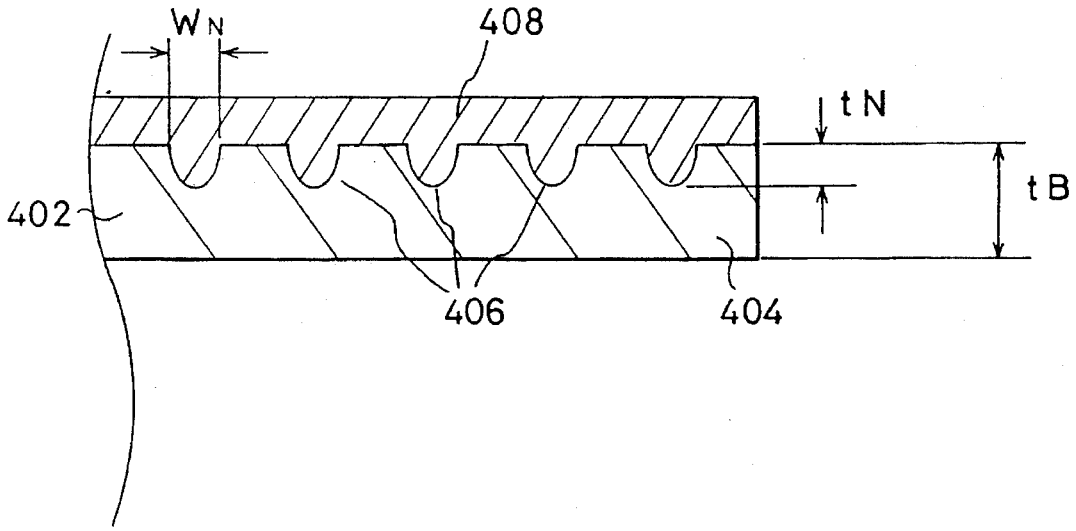
FIG. 18 is an elongated sectional view of an example of an electrode portion of the high-temperature oxide superconducting current lead illustrated in FIG. 17.

As illustrated in FIG. 18, the groove 406 has a U-shaped configuration in section, a predetermined depth $t_n$, and a predetermined width $W_n$. A ratio between the predetermined depth $t_n$ and a thickness $t_B$ of the cylindrical conductor portion 402 is given by $t_n/t_B$ and may be preferably smaller than 0.8.

In addition, the predetermined width $W_n$ is considerably larger than a predetermined particle size $W_D$ of the silver powder. This shows that the electrode forming portion 404 provides a smooth surface even when the groove 406 is formed on the electrode forming portion 404.

Figure 19:
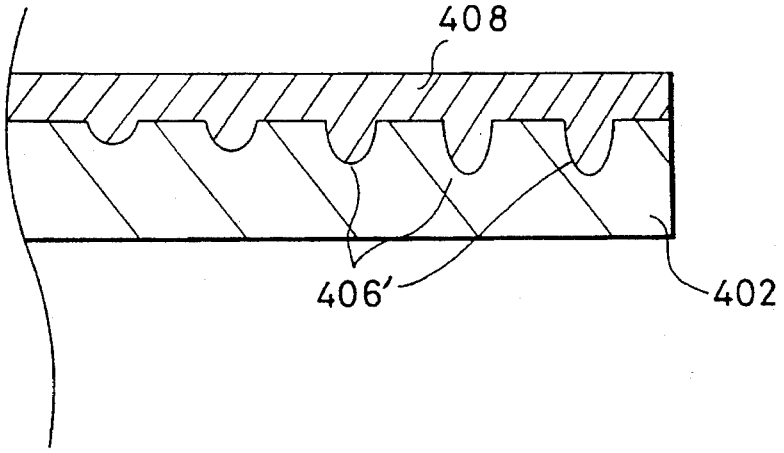
FIG. 19 is an elongated sectional view of another example of an electrode portion of the high-temperature oxide superconducting current lead illustrated in FIG. 17.

Alternatively, as illustrated in FIG. 19, the grooves 406' become gradually deep as they become close to an end of the cylindrical conductor portion 402. As a result, the depths of the grooves 406' are inclined towards the end of the cylindrical conductor portion 402.

In the above-mentioned example illustrated in FIGS. 18 and 19, the electrode forming portion 404 becomes weak in mechanical strength due to existence of the groove 406 or 406'. In addition, the cylindrical conductor portion 402 becomes narrow in sectional area by forming the grooves 406 or 406'. This results in a reduction of a current caused to flow through the oxide high-temperature superconducting current lead 400.

Figure 17:
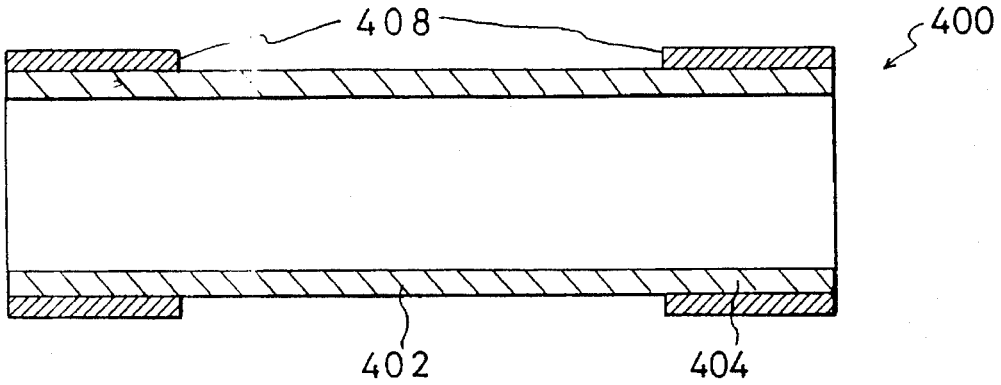
FIG. 17 is a sectional view of a high-temperature oxide superconducting current lead according to an eighth embodiment of this invention.
Figure 20:
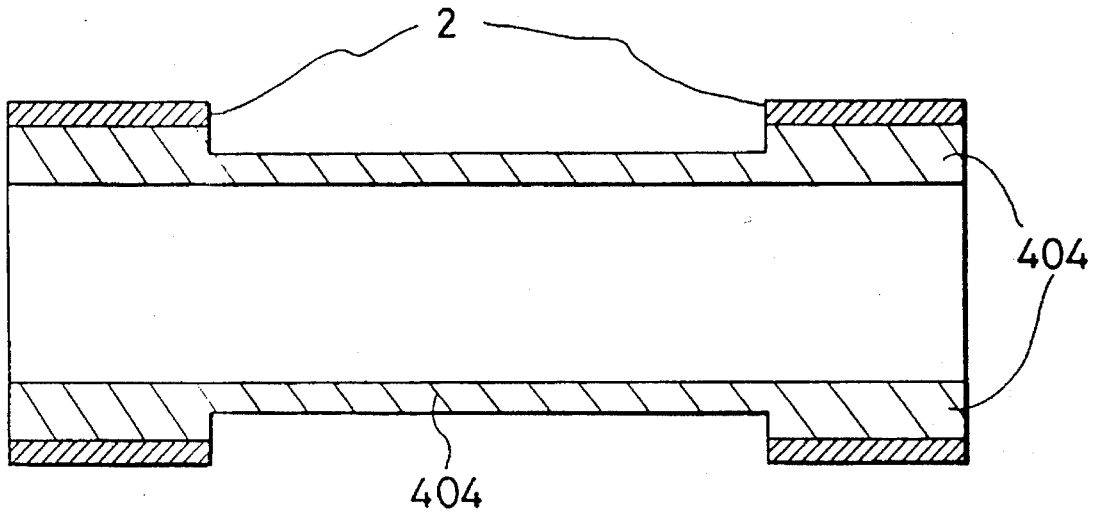
FIG. 20 is a sectional view of a high-temperature oxide superconducting current lead according to a modification of the high-temperature oxide superconducting current lead illustrated in FIG. 17.
Figure 21:
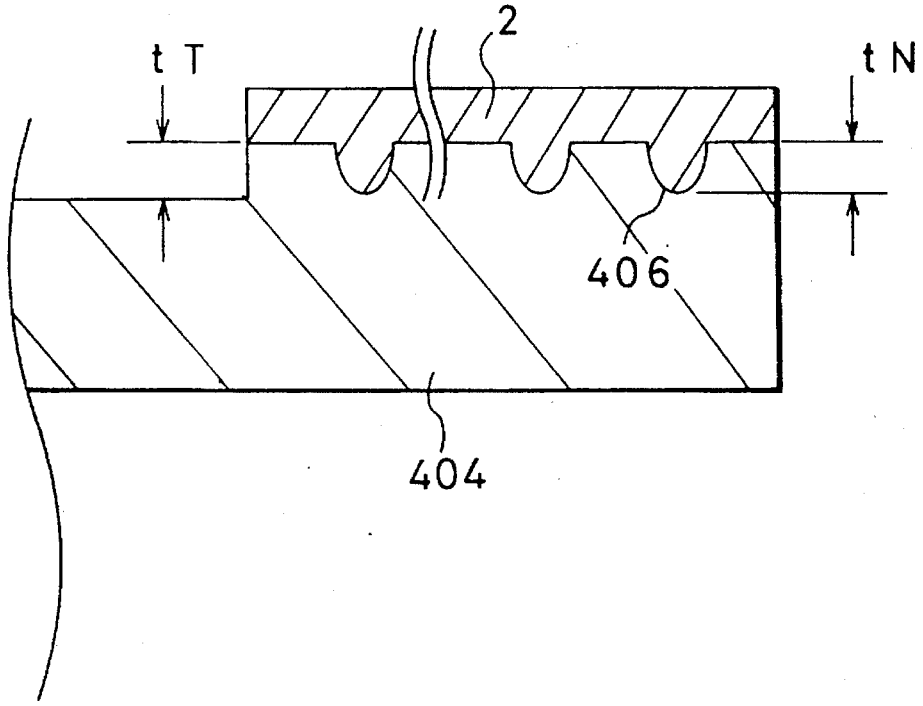
FIG. 21 is an elongated sectional view of an example of an electrode portion of the high-temperature oxide superconducting current lead illustrated in FIG. 20.

In order to solve this problem, the oxide high-temperature superconducting current lead 400 illustrated in FIGS. 17 to 19 may be modified in FIGS. 20 and 21.

As illustrated in FIGS. 20 and 21, the electrode forming portion 404 has an end portion thicker than a center portion thereof. The thickness of the end portion is larger than a sum of the thickness of the center portion and the depth of the groove 406.

In this example illustrated in FIGS. 20 and 21, the electrode forming portion 404 is strong in mechanical strength in comparison with that illustrated in FIGS. 18 and 19, in spite of the existence of the grooves 406. In addition, the cylindrical conductor portion 402 has an end portion which is not reduced. This serves to avoid a reduction of current caused to flow through the oxide high-temperature superconducting current lead 400.

Figure 22:
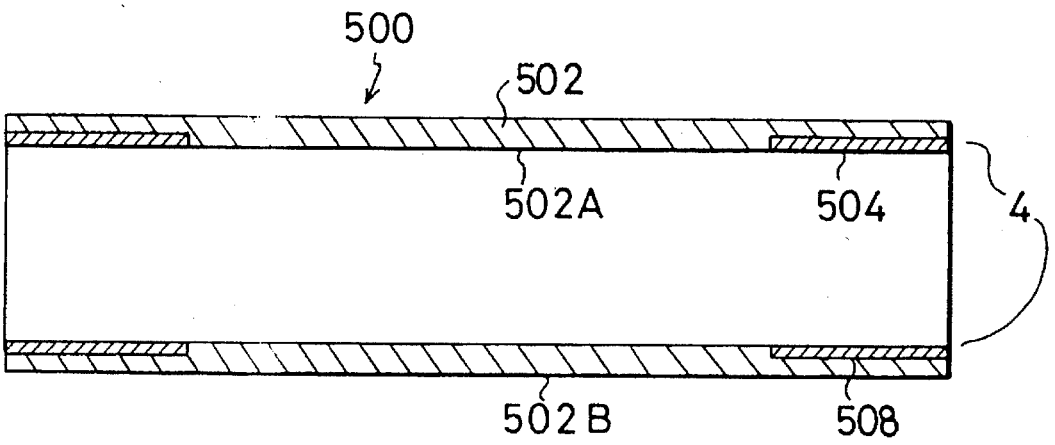
FIG. 22 is a sectional view of a high-temperature oxide superconducting current lead according to another modification of the high-temperature oxide superconducting current lead illustrated in FIG. 17.
Figure 23:
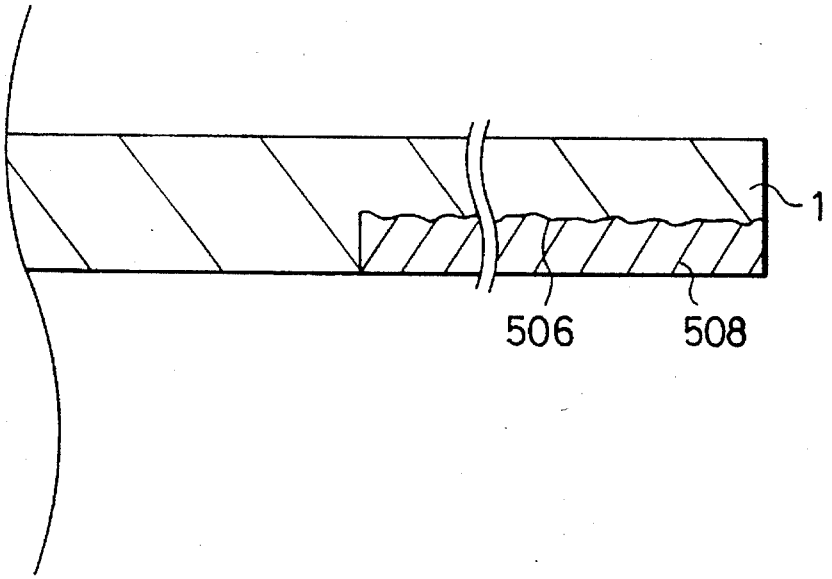
FIG. 23 is an elongated sectional view of an example of an electrode portion of the high-temperature oxide superconducting current lead illustrated in FIG. 22.

Referring to FIGS. 22 and 23, an oxide high-temperature superconducting current lead 500 comprises a cylindrical conductor portion 502 which has an inner cylindrical surface 502A and an outer cylindrical surface 502B, an electrode forming portion 504 which is formed inside of the inner cylindrical surface 502A and which has grooves 506 (FIG. 23). The electrode forming portion 504 acts as an electrode 508 which is formed on the inner cylindrical surface 502A and may be composed of, for example, silver.

In this example, the electrode 508 is well adhered to the cylindrical conductor portion 502.

Figure 24:
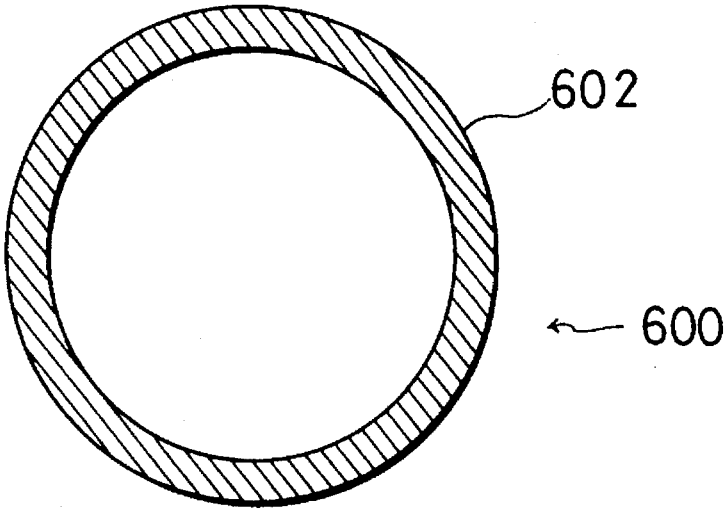
FIGS. 24(*a*) and (*b*) are sectional views of a terminal for use in a superconducting current lead according to a ninth embodiment of this invention, (a) is a horizontal sectional view, and (b) is a vertical sectional view.
Figure 24:
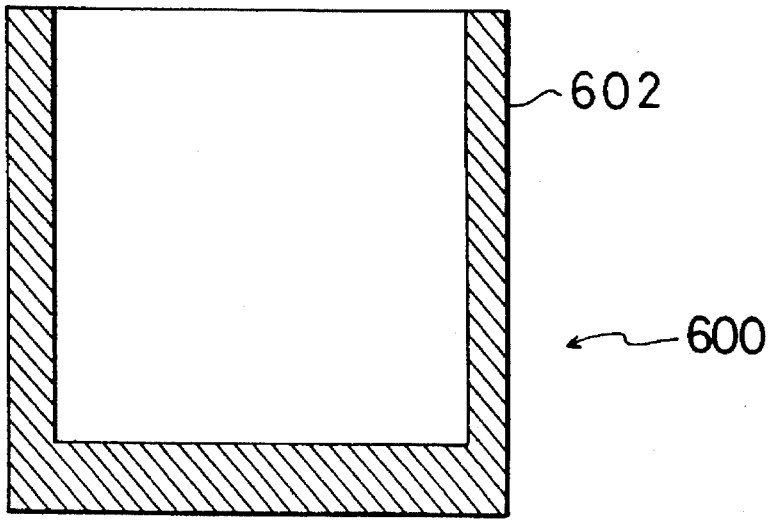
Figure 25:
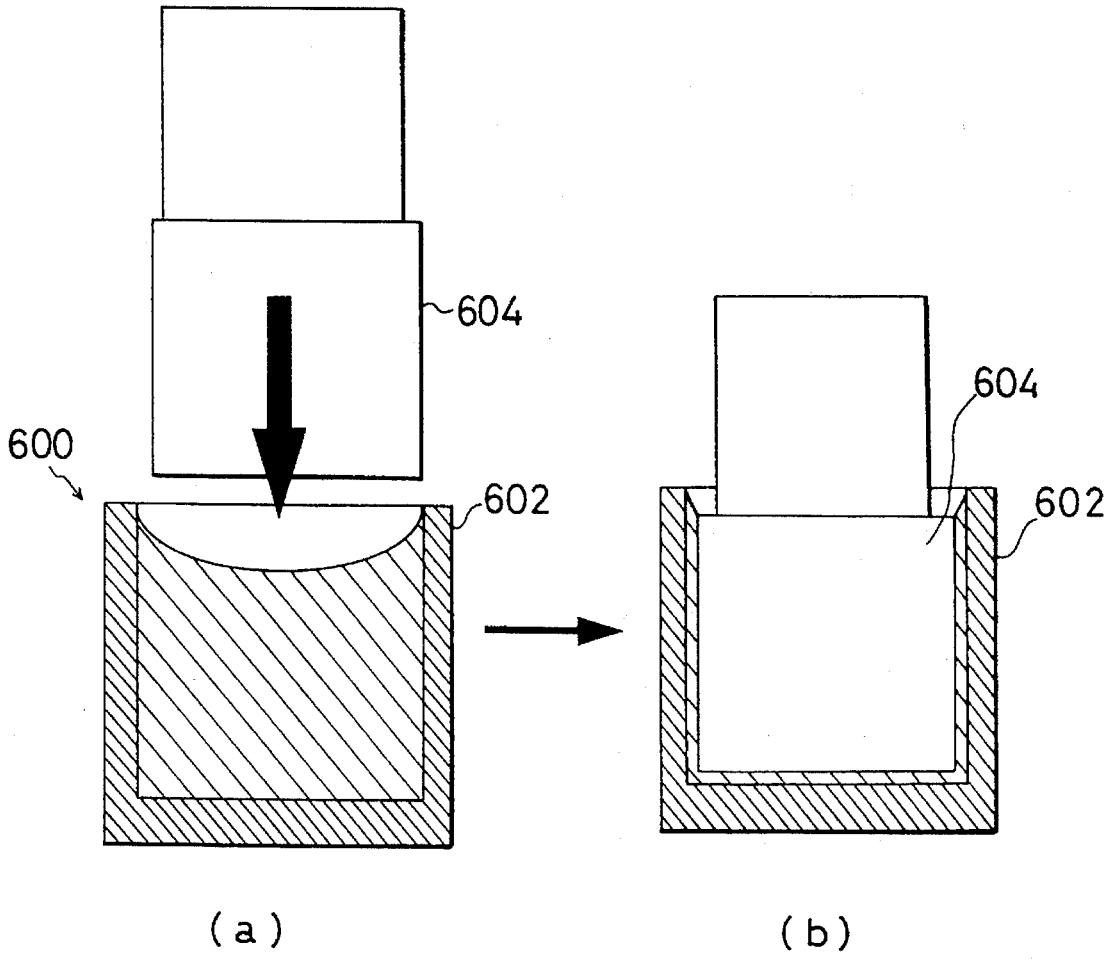
FIG. 25 is sectional views for describing how the terminal illustrated in FIG. 24 is mounted on the superconducting current lead, (a) shows the terminal into which the superconducting current lead has not yet been inserted, (b) shows the terminal into which the superconducting current lead has already been inserted.
Figure 26:
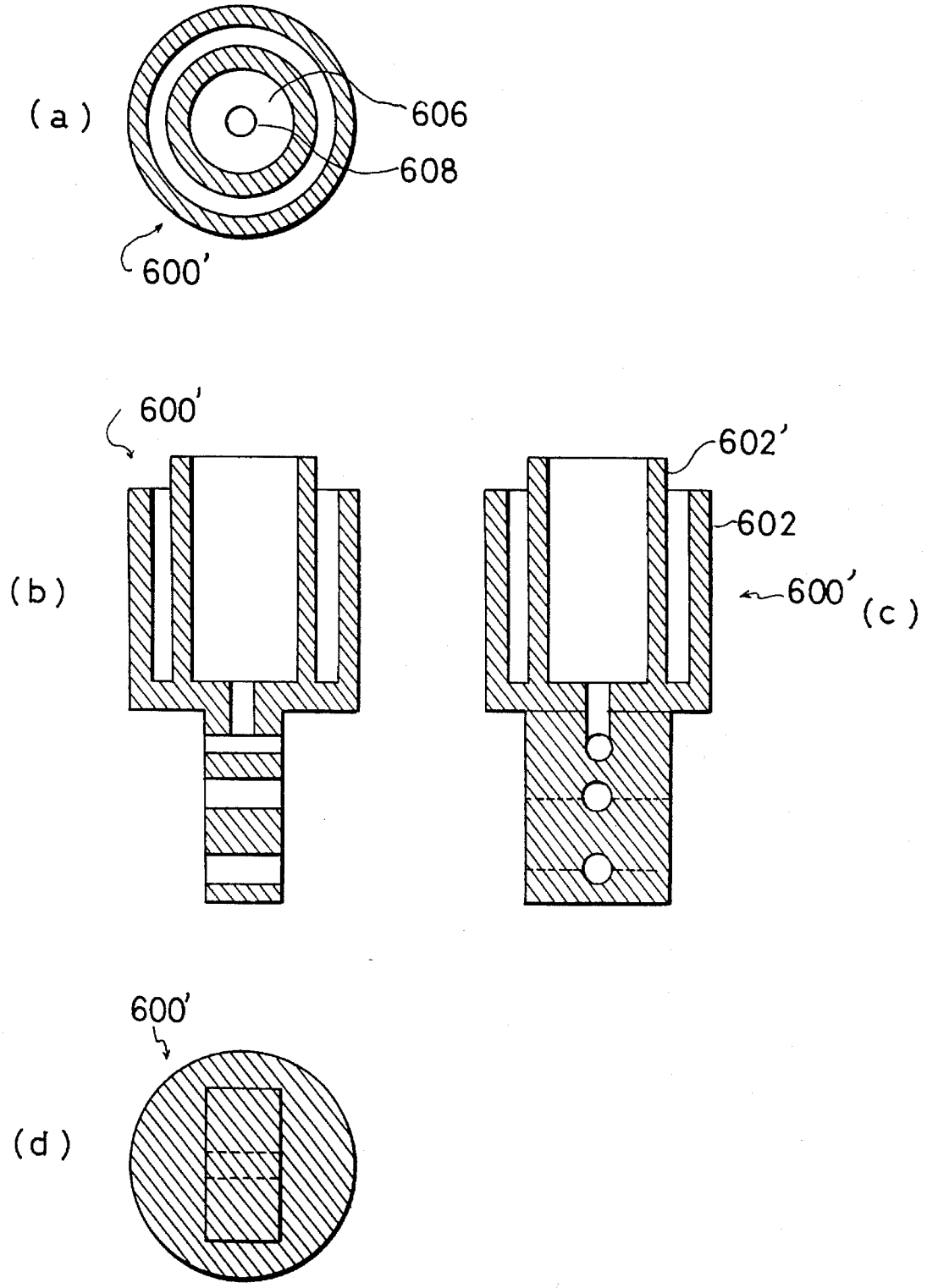
FIG. 26 is sectional views of a terminal for use in a superconducting current lead according to a modification of the terminal illustrated in FIG. 24 (a) and (d) are horizontal sectional views, and (b) and (c) are vertical sectional views.

Referring now to FIGS. 24, 25, and 26, description will proceed to a terminal for a superconducting current lead according to a ninth embodiment of this invention. The terminal for a superconducting current lead is for use in connecting an electric wiring with electrodes each of which is formed on each end of a cylindrical conductor portion.

As illustrated in FIGS. 24 and 25, a terminal 600 for a superconducting current lead comprises a terminal portion 602 which has a cup-like configuration of which an inner diameter is larger than an outer diameter of the electrode 604.

In FIG. 26, illustrated is a modification of the terminal 600 illustrated in FIGS. 24 and 25.

As illustrated in FIG. 26, a terminal 600' for a superconducting current lead further comprises an internal terminal portion 602' which has a cup-like configuration of which an outer diameter is smaller than an inner diameter of the electrode 604 (FIG. 25). The electrode 604 is inserted between the terminal portion 602 and the internal terminal portion 602'.

The terminal 600 or 600' for a superconducting current lead may be made of a material selected from a group consisting of copper, silver, and alloys thereof.

Preferably, in the terminal 600 or 600', the terminal portion 602 and the internal terminal portion jointly have a bottom portion 606, as illustrated in FIG. 26(*a*), which includes a throughhole 608 for exhausting a gas. In these examples, the terminal 600 or 600' is readily coupled to the superconducting current lead.

Figure 27:
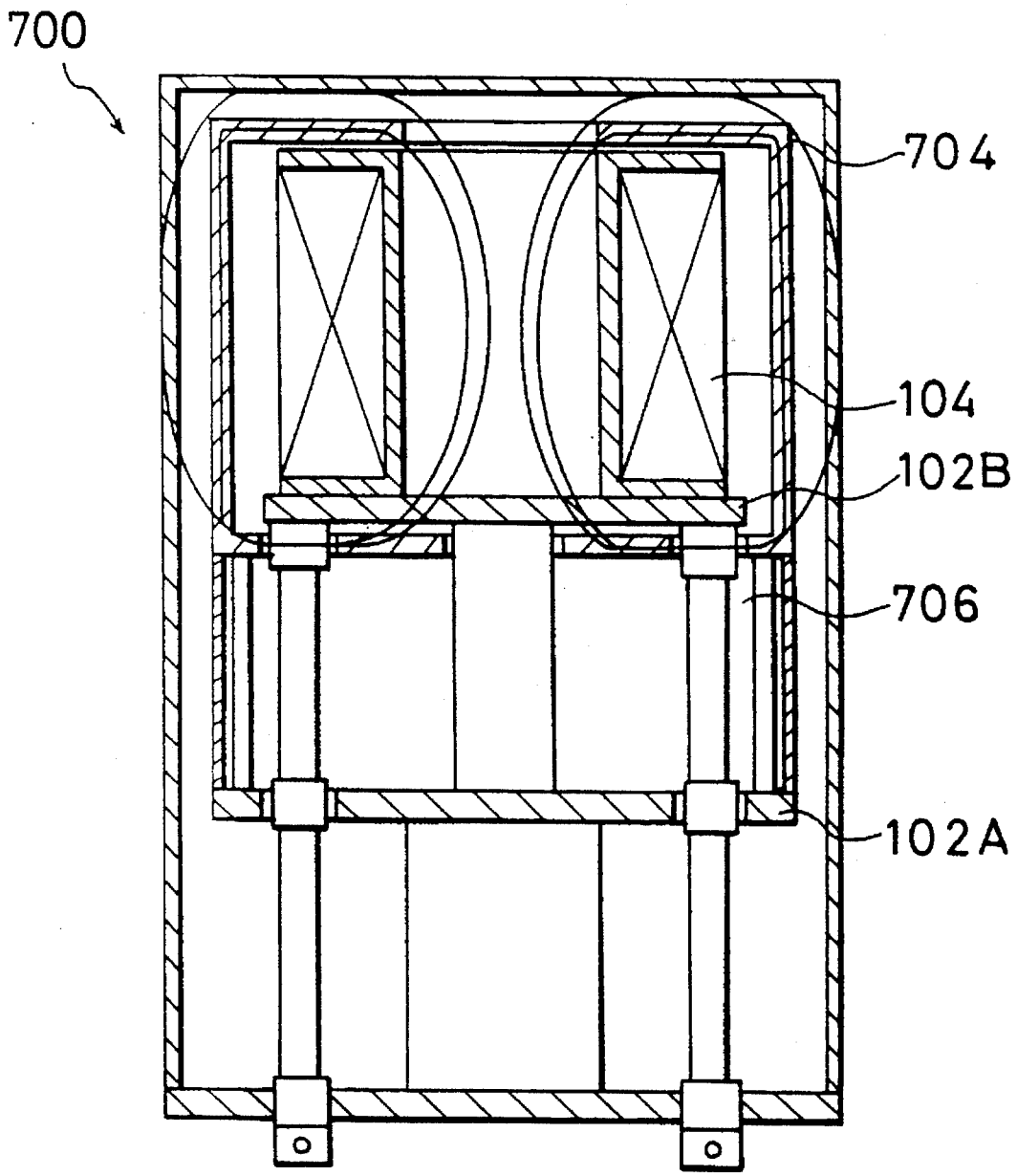
FIG. 27 is a partial vertical sectional view of a superconducting magnet system according to a tenth embodiment of this invention.

Referring now to FIG. 27, description will proceed to a superconducting magnet system according to a tenth embodiment of this invention.

The superconducting magnet system according to the tenth embodiment has a structure similar to that of the first embodiment except for the followings. Similar portions are designated by like reference numerals.

As illustrated in FIG. 27, a superconducting magnet system 700 comprises the superconducting coil member 104 which is mounted on the second cooling stage 102B, and a magnetic shield portion 704 magnetically shielding the superconducting coil member 104. The magnetic shield portion 704 surrounds the second cooling stage 102B as well as the superconducting coil member 104.

Preferably, the superconducting magnet system 700 further comprises a thermal conductive supporting rod 706 which is mounted on the first cooling stage 102A. The magnetic shield portion 704 is supported by the thermal conductive supporting rod 706.

In the above-described example, an excellent magnetic shield effect can be achieved since the magnetic shield portion 704 is extended to the lower magnetic field section which is remote from the superconducting coil member 104. This means that magnetic saturation scarcely takes place in the magnetic shield portion 704 because of a wide area of the magnetic shield portion 704.

The magnetic shield portion 704 serves not only as a magnetic shield member but also a radiation shield member. As a result, the superconducting magnet system becomes compact in size. Besides, the magnetic shield portion 704 is not only cooled by the second cooling stage 102B but also cooled by the first cooing stage 102A through the thermal conductive supporting rod 706.

Figure 28:
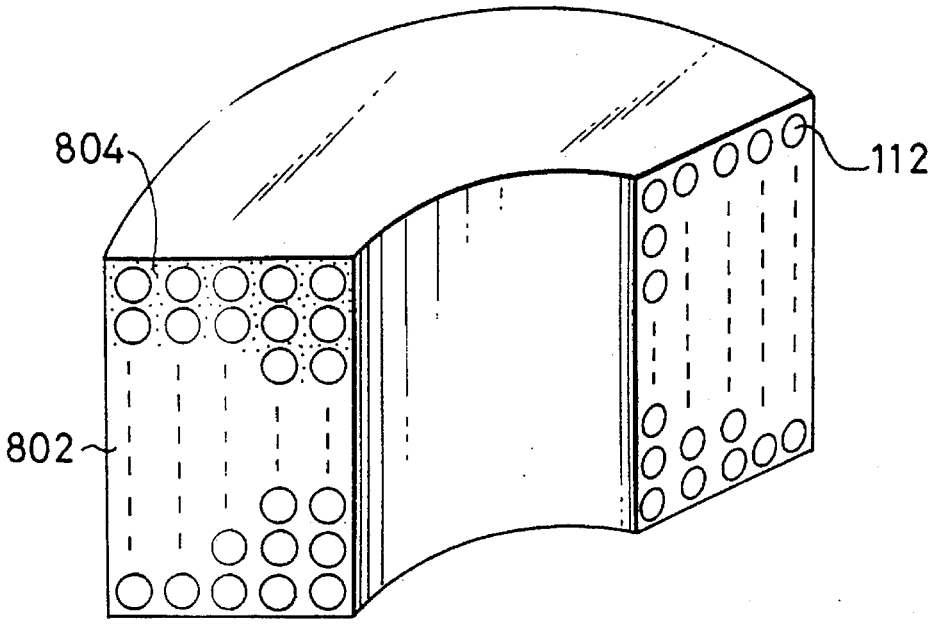
FIG. 28 is a partially sectional perspective view of a superconducting magnet according to an eleventh embodiment of this invention.
Figure 29:
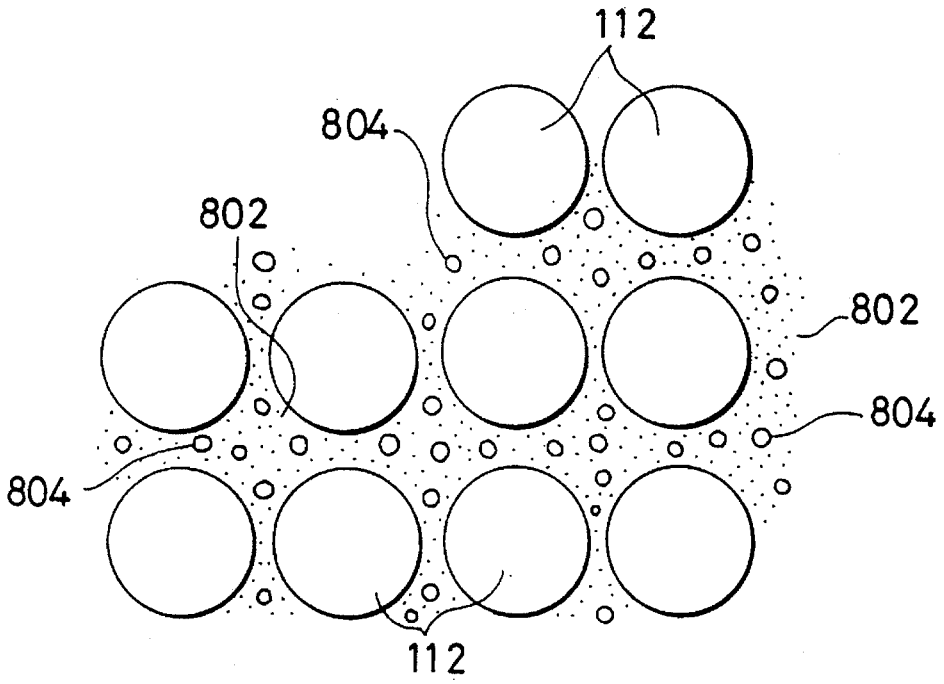
FIG. 29 is an elongated sectional view of the superconducting magnet illustrated in FIG. 28.

Referring to FIGS. 28 and 29, description will proceed to a superconducting magnet system according to an eleventh embodiment of this invention.

The superconducting magnet system according to the eleventh embodiment has a structure similar to that of the first embodiment except for the followings. Similar portions are designated by like reference numerals.

As illustrated in FIGS. 28 and 29, the superconducting wire 112 is impregnated with an impregnating material 802 having a first predetermined thermal conductivity. The impregnating material 802 is mixed with an insulating material 804 having a second predetermined thermal conductivity higher than the first predetermined thermal conductivity.

The impregnating material 802 is, for example, made of epoxy resin which has the first predetermined thermal conductivity of 0.0018 watt/cm.K. The insulating material 804 is made of aluminum nitride which has the second predetermined thermal conductivity higher than 0.0018 watt/cm.K.

In addition, the insulating material 804 is powdery. Preferably, a particle size of the powder of the insulating material 804 is not more than 10 micron meters.

A mixture ratio between the insulating material 804 and the impregnating material 802 is preferably 1:1.

Thus, the impregnating material 802 is mixed with the insulating material 804 which has a thermal conductivity higher than that of the impregnating material 802. The thermal conductivity of the impregnating material 802 is, as a whole, so far increased. As a result, the superconducting coil member 104 (FIG. 1) can be cooled very efficiently. In this event, it becomes possible to cool the superconducting coil member 104 in a short time.

While this invention has thus far been described in conjunction with several embodimens thereof, it will readily be possible for those skilled in the art to put this invention into practice in various other manners. For example, the current leads may not be always kept in contact with the cooling stage. On the other hand, more than two pairs of the current leads may also be employed.

What is claimed is:

1. A superconducting magnet system comprising:

a cryocooler which has a cooling stage cooled down to a predetermined temperature;

a superconducting coil member which is kept in contact with said cooling stage to thereby be cooled to said predetermined temperature by said cryocooler; and a ceramic current lead of a cylindrical shape having first and second end portions for supplying an electric current to said superconducting coil member; and at least one of said first end portion and said second end portion being a free end.

2. A superconducting magnet system as claimed in claim 1, wherein said current lead is kept in contact with said cooling stage.

3. A superconducting magnet system as claimed in claim 1, wherein said current lead is surrounded by a magnetic shield formed by a superconductive material.

4. A superconducting magnet system as claimed in claim 3, wherein said magnetic shield is formed by a high temperature superconducting material.

5. A superconducting magnet system as claimed in claim 1, wherein said cryocooler further comprises at least one additional cooling stage cooled down to an additional temperature higher than said predetermined temperature, said first end portion being kept in contact with said cooling stage while said second end portion is kept in contact with said additional cooling stage.

6. A superconducting magnet system as claimed in claim 1, wherein both said first end portion and said second end portion are free ends.

7. A superconducting magnet system as claimed in claim 1, further comprising two flexible circular electrodes, wherein both said first and said second end portions are elastically supported through said two flexible circular electrodes.

8. A superconducting magnet system as claimed in claim 1, further comprising an electrode and a flexible circular electrode, said electrode being positioned between said current lead and said cooling stage, said flexible circular electrode being interposed between said electrode and said current lead.

9. A superconducting magnet system as claimed in claim 1, further comprising:

a magnetic shield portion of a high-temperature superconducting material which surrounds said current lead and which is kept in contact with said cooling stage.

10. A superconducting magnet system as claimed in claim 1, wherein said cryocooler further comprises at least one additional cooling stage cooled down to an additional temperature higher than said predetermined temperature.

11. A superconducting magnet system as claimed in claim 10, further comprising a magnetic shield portion which surrounds said current lead and which is located between said cooling stage and said additional cooling stage.

12. A superconducting magnet system as claimed in claim 11, wherein said magnetic shield portion is kept in contact with said cooling stage.

13. A superconducting magnet system as claimed in claim 12, wherein said magnetic shield portion is made of a superconducting material.

14. A superconducting magnet system as claimed in claim 11, wherein said magnetic shield portion is extended from said additional cooling stage.

15. A superconducting magnet system as claimed in claim 14, wherein said magnetic shield portion is made of a high-temperature superconducting material.

16. A superconducting magnet system as claimed in claim 11, wherein said magnetic shield portion is composed of an oxide high-temperature superconducting material and a thermal conductive metal.

17. A superconducting magnet system as claimed in claim 16, wherein said thermal conductive metal is selected from a group consisting of copper, silver, and aluminum.

18. A superconducting magnet system as claimed in claim 1, wherein said superconducting coil member comprises a coil bobbin and a superconducting wire wound around said coil bobbin;

said superconducting magnet system further comprising:

cooling promoting means surrounding said superconducting wire for promoting the cooling of said superconducting wire, with both said superconducting coil member and said cooling promoting means kept in contact with said cooling stage.

19. A superconducting magnet system as claimed in claim 18, wherein said cooling promoting means are made of a thermal conductive material.

20. A superconducting magnet system as claimed in claim 18, wherein said cooling promoting means comprises a plurality of segments which are azimuthally divided and fastened together to fix said superconducting coil member therein.

21. A superconducting magnet system as claimed in claim 1, wherein said superconducting coil member is surrounded by a magnetic shield member formed by a material comprising iron.

22. A superconducting magnet system as claimed in claim 1, further comprising a superconducting coil member mounted on said cooling stage, and a magnetic shield portion magnetically shielding said superconducting coil member, wherein said magnetic shield portion surrounds said cooling stage along with said superconducting coil member.

23. A superconducting magnet system as claimed in claim 22, further comprising a thermal conductive supporting member which is mounted on said additional cooling stage, said magnetic shield portion being supported by said thermal conductive supporting member.

* * * * *